US009865234B2

(12) United States Patent
Denton

(10) Patent No.: US 9,865,234 B2
(45) Date of Patent: Jan. 9, 2018

(54) METHOD AND APPARATUS FOR ADJUSTABLY ASSOCIATING TWO COMPONENTS OF A STRINGED MUSICAL INSTRUMENT

(76) Inventor: Robert P. Denton, Morganton, NC (US)

( * ) Notice: Subject to any disclaimer, the term of this patent is extended or adjusted under 35 U.S.C. 154(b) by 759 days.

(21) Appl. No.: 13/210,570

(22) Filed: Aug. 16, 2011

(65) Prior Publication Data

US 2013/0042740 A1 Feb. 21, 2013

(51) Int. Cl.
*G10D 3/00* (2006.01)
*G10D 3/06* (2006.01)

(52) U.S. Cl.
CPC ..... *G10D 3/06* (2013.01)

(58) Field of Classification Search
USPC ..... 84/293
See application file for complete search history.

(56) References Cited

U.S. PATENT DOCUMENTS

| | | | | |
|---|---|---|---|---|
| 1,671,942 | A | 9/1926 | Strupe | |
| 4,638,708 | A * | 1/1987 | Kamal | G10D 3/06 84/293 |
| 5,353,672 | A * | 10/1994 | Stewart | G10D 3/06 84/267 |
| 5,679,910 | A | 10/1997 | Steinberger et al. | |
| 5,949,005 | A * | 9/1999 | Peterson | G10D 1/085 84/267 |
| 5,961,266 | A * | 10/1999 | Tseng | 411/383 |
| 6,262,353 | B1 | 7/2001 | Murray | |
| 6,353,164 | B1 | 4/2002 | Corsi | |
| 6,657,112 | B1 | 12/2003 | Zigounakis | |
| 6,664,453 | B2 | 12/2003 | Ito et al. | |
| 6,765,137 | B2 | 7/2004 | Smart | |
| D561,238 | S | 2/2008 | Butler et al. | |
| 7,326,838 | B1 | 2/2008 | Bunker | |
| D576,280 | S | 9/2008 | Bullemer et al. | |
| 7,557,281 | B1 | 7/2009 | Campling | |
| 7,816,592 | B2 | 10/2010 | Babicz | |
| 2009/0188370 | A1 | 7/2009 | DeJule | |
| 2009/0308221 | A1 | 12/2009 | Babiez | |
| 2010/0282041 | A1 | 11/2010 | Bishop | |
| 2010/0294110 | A1 | 11/2010 | Towner | |
| 2011/0011238 | A1 | 1/2011 | Toone | |

* cited by examiner

*Primary Examiner* — Christopher Uhlir
(74) *Attorney, Agent, or Firm* — Monty Simmons; Simmons Patents

(57) ABSTRACT

The present invention relates to a method and apparatus for adjustably associating two components such as two components of a stringed instrument. Such invention is particularly well suited for adjusting the action of a guitar and for allowing any one of a plurality of guitar necks to be quickly and easily associated with a guitar body. One embodiment of the invention includes associating a body-plate with a body interface defined by guitar body and configured for being mechanically associated with a neck-plate associated with a guitar neck wherein the body-plate in the neck-plate are movably associated with each other so that the action of the guitar maybe easily adjusted. Another embodiment of the invention utilizes a pintle block and pillow block configuration for providing the same function. Additionally, a method is disclosed for using such apparatus to define a universal body interface and an universal neck interface allowing any one of a plurality of guitar necks to be quickly and easily associated with any one of a plurality of guitar bodies.

20 Claims, 23 Drawing Sheets

Prior Art

METHOD AND APPARATUS FOR ADJUSTABLY ASSOCIATING TWO COMPONENTS OF A STRINGED MUSICAL INSTRUMENT

TECHNICAL FIELD OF THE INVENTION

The present invention relates to a method and apparatus for adjustably associating two components such as the components of a stringed instrument. Such invention is particularly well suited for adjusting the action of a guitar and for allowing a person to select one of a plurality of possible body/neck configurations.

BACKGROUND OF THE INVENTION

Stringed instruments with hollow bodies configured to generate music were used by peoples of ancient civilizations. One type of such stringed instrument is the guitar. The oldest known iconographic representation of an instrument displaying the essential features of a guitar, for example, is a 3,300 year old stone carving of a Hittite bard, a Bronze Age people of Anatolia.

Guitars are commonly made and repaired by luthiers. The guitar is a plucked string instrument, usually played with fingers and/or a pick. Guitars are traditionally constructed of various woods and strung with animal gut or, more recently, with either nylon or steel strings. Some modern guitars are made of various synthetic materials such as polycarbonate.

There are two primary families of guitars: acoustic and electric. Guitars and stringed musical instruments in general normally include a headstock with tuners associated with one end of a neck. Such neck defines a fret board with the opposing end of the neck associate with the guitar's body. For acoustic guitars, at some point along the body is a bridge secured to the body with a saddle. One or more strings are stretched from the tuners over the nut, over the neck/fret board (finger board) and over a top portion of the body (sound board) to contact points on the bridge saddle.

For electric guitars, at some point along the top surface of the body are electronic pickups in alignment with a bridge that is also secured to the body. One or more strings are stretched from the tuners over the neck and fret board and over an electronic pickups to contact points on the bridge.

The tone of an acoustic guitar is produced by the vibration of the strings, which is amplified by resonance within the hollow defined by the acoustic guitar's body causing the sound board (top/front surface of the body) to resonate. Such is a limitation of acoustic guitars as if one wishes to generate a louder sound, a bigger soundboard is required (i.e. a bigger body). Evolutions in technology, particularly in the area of electronics, resulted in the creation of the electric guitar around 1930. Electric guitars do not rely on resonance in the same way acoustic guitars do as electric guitars rely on an electric amplifier to amplify and electrically manipulate the tone of the string vibrations.

One problem with both acoustic and electric stringed instruments that has been the bane of many luthiers' and guitarists' existences relates to adjusting the "action" of the instrument. The distance from a string to a fret associated with a fret board (i.e. the "height" of the string relative to the fret board/frets) is generally referred to as the guitar's "action" (or string action). For the purposes of this document, such "action" will be referred to as the "string action" or perhaps simply "action". Often a musician will choose to have the instrument's action set to different heights depending on the type of music being played or playing style favored. Lower action, lighter (thinner) strings, and electrical amplification lend the electric guitar to techniques less frequently used on acoustic guitars. These include tapping, extensive use of legato through pull-offs and hammer-ons (also known as slurs), artificial harmonics, volume swells, and use of a tremolo arm or effects pedals. Thus, certain musicians prefer to have a small distance between the fret board and string or "low" action, while others prefer a "high" action for various reasons, one of which is to avoid fret buzzing. Additionally, many players wish to have a predefined height between the strings and the face of the body of the guitar in the area where plucking or picking is performed. For the purposes of this document, we will refer to such attribute as the "pick action". When the pick action is too small, a player has a tendency to hit the face of the guitar while strumming the strings.

Prior art devices, relating to how an instrument's neck is associated with such instrument's body, have been developed to allow for adjusting the "string action" of a stringed instrument. All such prior art devices, however, have their issues. Many such devices, while adjustable, must be locked in place after adjustment. Such a design requires the instrument's user to not only keep up an adjustment tool, but the tools necessary to unlock the device. Other such devices, while they work well for their intended purposes, required extensive modification to retrofit an existing guitar with such a device. Additionally, such retrofitted guitars will have visible modifications of which many users do not desire to be seen. Additionally, going back from such a retrofitted guitar to the stock configuration, if doable, requires extensive repairs. Further, such prior art devices are not easily incorporated into a manufacturing process making mass production of guitars with such features less economically feasible. Further, it is desirable to have a method of adjusting the "string action" without substantially affecting the "pick action".

Finally, none of the devices define a universal neck/body association that would allow a music store customer (for example) to pick and choose the neck/body configuration, from a plurality of possible choices, for the guitar he wished to purchase. The Applicant's invention addresses all the above issues.

SUMMARY

Some of the objects and advantages of the invention will now be set forth in the following description, while other objects and advantages of the invention may be obvious from the description, or may be learned through practice of the invention.

Broadly speaking, a principle object of the present invention is to provide an apparatus for movably associating two components comprising a first plate configured for being mechanically associated with a first component and a second plate configured for being mechanically associated with a second component, a pivot member suitably configured for movably associating said first plate with said second plate, and an adjustment mechanism configured for changing the distance between the first plate and the second plate.

Yet another object of the present invention is to provide an adjustable neck body interface apparatus configured for adjustably associating the neck of a stringed instrument with the body of a stringed instrument wherein said apparatus may be manipulated to adjust the string action of a least one string of the stringed instrument. Preferably, such adjustments in string action will have minimal effects on the stringed instruments pick action (for stringed instruments, such as guitars, comprising a pick area).

Another general object of the present invention is to provide an adjustable neck body interface apparatus configured for adjustably associating the neck of a stringed instrument with the body of a stringed instrument wherein the apparatus may be manipulated to adjust the string action of a plurality of strings while not substantially affecting the pick action.

Another general object of the present invention is to provide an apparatus for adjustably associating the neck of a stringed instrument with the body of a stringed instrument wherein the only visible adjustment means is an adjustment access port and associated adjustment mechanism and wherein said apparatus may be manipulated to adjust the string action of a least one string of the stringed instrument.

Another general object of the present invention is to provide an adjustable neck/body interface kit configured for retrofitting string instruments wherein such neck/body interface kit movably associates the neck of a string instrument with the body of a stringed instrument and wherein said adjustable neck/body interface kit is configured to use at least part of the stringed instrument's existing hardware so that the only externally visible adjustment means is an adjustment access port and associated adjustment mechanism.

Another object of the present invention is to provide a universal adjustable neck body interface apparatus configured for adjustably associating the neck of a stringed instrument with the body of a stringed instrument wherein such universal adjustable neck/body interface is configured so that a plurality of stringed instrument necks of different types may be quickly and easily associated with a plurality of stringed instrument bodies of different types.

Yet another object of the present invention is to provide a universal adjustable neck body interface apparatus configured for adjustably associating the neck of a stringed instrument with the body of a stringed instrument wherein such universal adjustable neck/body interface is configured so that a plurality of stringed instrument necks of different types may be associated with a plurality of stringed instrument bodies of different types and wherein the only visible adjustment means is an adjustment access port and wherein said universal adjustable neck/body interface may be manipulated to adjust the action of a least one string of the stringed instrument.

Yet another object of the present invention relates to a method of universally adjustably associating the body of an instrument and the neck of an instrument so that a plurality of stringed instrument necks of different types may be quickly, easily and adjustably associated with a plurality of stringed instrument bodies of different types without modifications to the body or the neck. Preferably, the only visible adjustment means is an adjustment access port and associated adjustment mechanism configured for adjusting the string action of a least one string of the stringed instrument.

Additional objects and advantages of the present invention are set forth in the detailed description herein or will be apparent to those skilled in the art upon reviewing the detailed description. Also, it should be further appreciated that modifications and variations to the specifically illustrated, referenced, and discussed steps, or features hereof may be practiced in various uses and embodiments of this invention without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of this invention may include various combinations or configurations of presently disclosed features or elements, or their equivalents (including combinations of features or parts or configurations thereof not expressly shown in the figures or stated in the detailed description).

Those of ordinary skill in the art will better appreciate the features and aspects of such embodiments, and others, upon review of the remainder of the specification.

BRIEF DESCRIPTION OF THE DRAWINGS

A full and enabling description of the present subject matter, including the best mode thereof, directed to one of ordinary skill in the art, is set forth in the specification, which makes reference to the appended figures, in which.

Figure 1:
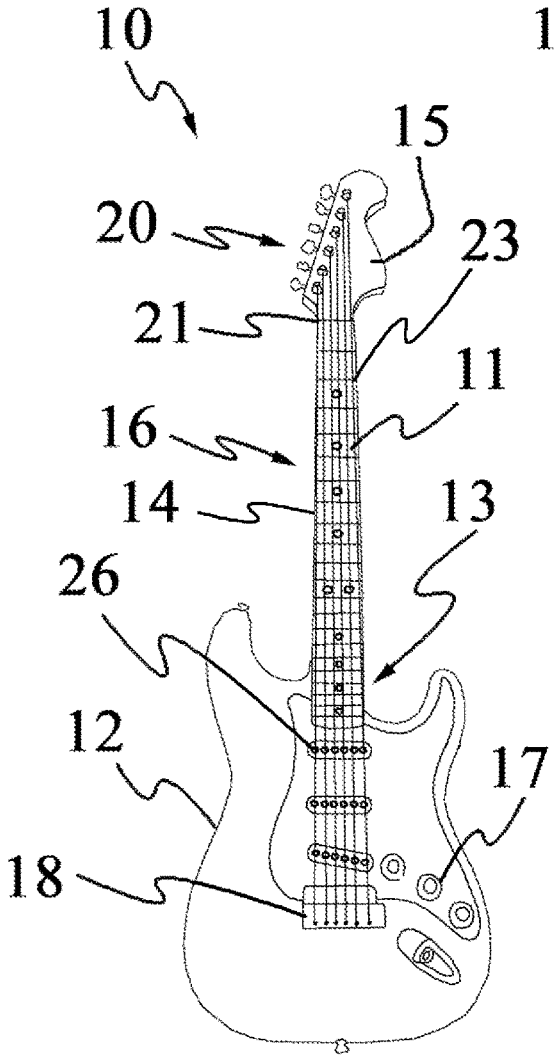
FIG. 1 is a front plan view of a prior art electric guitar.

Repeat use of reference characters throughout the present specification and appended drawings is intended to represent the same or analogous features or elements of the present technology.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention covers such modifications and variations as come within the scope of the appended claims and their equivalents. Other objects, features, and aspects of the present invention are disclosed in or may be determined from the following detailed description. Repeat use of reference characters is intended to represent same or analogous features, elements or steps. It is to be understood by one of ordinary skill in the art that the present discussion is a description of exemplary embodiments only, and is not intended as limiting the broader aspects of the present invention.

For the purposes of this document two or more items are "associated" by bringing them together or into relationship with each other in any number of ways including a direct or indirect physical connection that may be a permeate connection, a temporary or releasable connection, a ridged connection or a connection that allows relative movement between the items being associated with each other. Similarly, if this document contains electronic features, two or more items are "electrically associated" by bringing them together or into relationship with each other in any number of ways including: (a) a direct, indirect or inductive communication connection, and (b) a direct/indirect or inductive power connection.

For the purposes of this document, as described below, the distance between the strings and the frets of a stringed instrument is referred to as the "string action". That said, it should be appreciated that some musical instruments comprise a body associated with a neck where such neck defines a fingerboard without frets. For the purposes of this document, for such devices, the term "string action" refers to the distance between the strings and the fingerboard. Additionally, as described below, the distance between the strings and the face of the body of the guitar in the area where picking is performed is referred to as the "pick action".

This document contains headers. Such headers are "place markers" inserted for the convenience of a reader and have no other meaning or effect on the construction of this document in any way and should not to be used in the construction of this document.

While the particulars of the present invention and associated technology may be adapted for movably associating two components such as any stringed instrument with projecting necks (including instruments comprising hollow bodies such as guitars, violins, cellos, mandolins, and ukuleles), the examples discussed herein are primarily in the context of adjustably associating a neck to a body of a solid bodied or hollowed bodied electric guitar or some hollowed bodied acoustic guitars.

Figure 2:
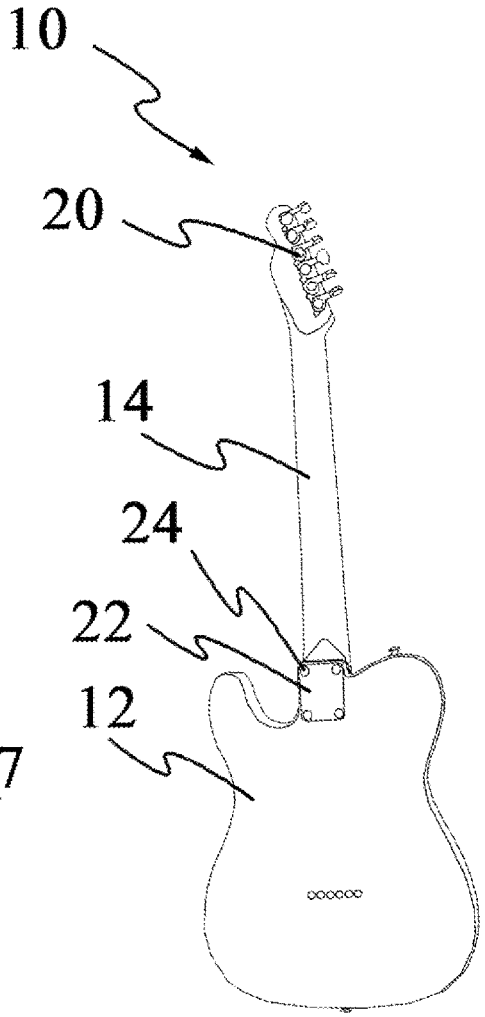
FIG. 2 is a back plan view of the guitar depicted in FIG. 1.
Figure 2A:
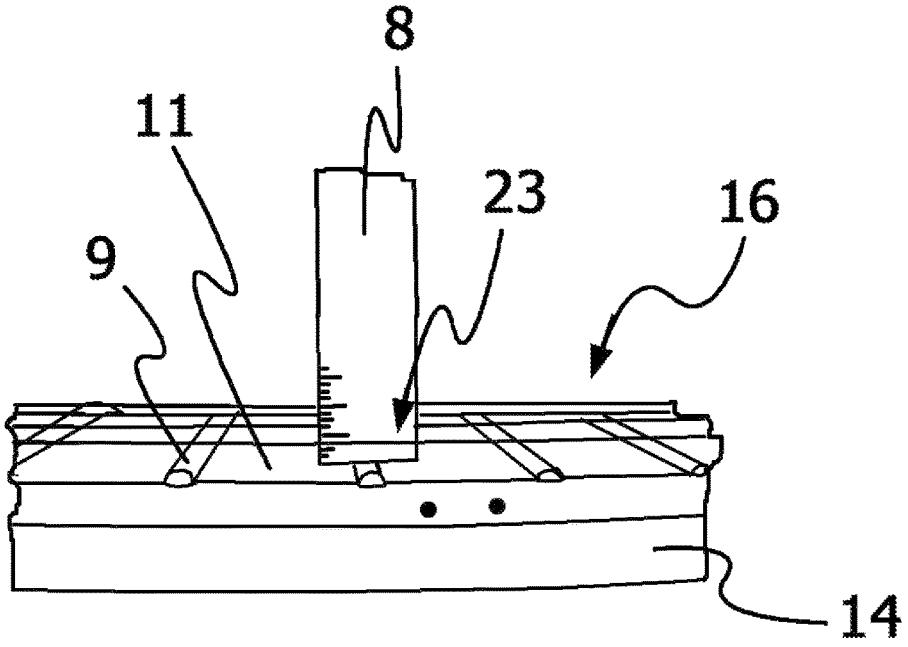
FIG. 2*a* is a side perspective view of a portion of the neck of the guitar depicted in FIG. 1 showing a ruler indicating the string height relative to the frets ("action") of the guitar in FIG. 1.

Referring now to FIG. 1, FIG. 2, and FIG. 2*a*, a prior art stringed instrument, guitar (10), is presented comprising a neck assembly (14) associated with a body assembly (12). FIG. 1 presents a front view of guitar (10) and FIG. 2 presents a back view. The front side of neck assembly (14) defines a fret board (11) disposed between a first neck end and an opposing second neck end. As will be described below, a guitar's frets, fret board, headstock, and tuners are all associated with an "extension" and are collectively referred to as the guitar's neck assembly (14). Additionally, some neck assemblies include a truss rod and some neck assemblies do not include frets. The point at which the neck is associated with the body is referred to as the neck-body interface, and for most prior art guitars, such neck-body interface is either bolted or glued to the body of the guitar and is not normally considered "adjustable" without modifications. As depicted in FIG. 1, the first end of neck assembly (14) is associated with body assembly (12) at neck-body interface (13). Neck assembly (14) extends from said neck-body interface (13), a predefined distance, to the opposing second end of neck assembly (14). Such second end of neck assembly (14) is associated with headstock (15) comprising a plurality of tuning keys (20). For a guitar, headstock (15) is the same as "head (15)"). Further, it should be appreciated that there are many different types of neck assembly profiles available; giving a guitarist many options, although, with prior art guitars, (and while most anything can be done using enough money and effort), using the same body assembly and switching between a plurality of necks is not easily and/or cost-effectively done.

At least part of the front surface of neck assembly (14) defines fret board (11) comprising a plurality of frets (9, FIG.

2*a*). As defined above, for musical instruments not containing frets, the term "fret board" refers to "fingerboard". Thus, one of ordinary skill in the art will appreciate that "fret board (11)" may also be accurately referred to as a "finger board (11)". Fret board (11) may define a flat surface or it may be slightly curved. If curved, the curvature of the fret board is measured by the fret board radius, which is the radius of a hypothetical circle of which the fret board surface constitutes a segment.

The body assembly (12) for Guitar (10) may comprise a bridge (18) mechanically associated with the front surface of body assembly (12). For acoustic guitars, such front surface is often referred to as a "sound board". Guitar (10) further comprises a plurality of strings (16) wherein the first end of each of said plurality of strings (16) are mechanically associated with bridge (18). For most guitars (10) there are six strings. Strings (16) extend from bridge (18) along the front surface of body assembly (12) (often referred to as the "sound board"), over fret board (11), over frets (9), over the nut (21), and to the tuning keys (20) associated with headstock (15). For acoustic guitars, the bridge not only holds the strings (16) in place, the bridge transfers the vibrations from the strings to the "sound board" for amplification via a resonance chamber. For electric guitars, as the one depicted in FIG. 1, bridge (18) simply holds the strings (16) in place and each string (16) passes over an electronic pickup (26) which transfers the string vibrations to electronic circuits for amplification. Such electronic amplification may be adjusted using electronic controls (17).

A nut (21) is disposed at the transition point between the second end of neck assembly (14) and headstock (15). Nut (21) is typically a small strip of bone, plastic, brass, corian, graphite, stainless steel, or other medium-hard material. Nut (21) is grooved to guide the strings onto the fret board (11), giving consistent lateral string placement across fret board (11).

Referring to FIG. 1 and FIG. 2*a*, embedded along front surface of fret board (11), between nut (21) and neck-body interface (13), are frets (9) disposed at predefined locations. It should be appreciated that body assembly (12) and its associated bridge (18) and neck assembly (14) and its associated nut (21) and headstock (15) alignments are set so that strings (16) do not touch the frets (9) unless pressure is applied (usually using a fingertip) pushing a string against a fret (9).

As previously noted, the distance between strings (16) and frets (9) is typically referred to as the instrument's "string action" (23) as being measured by ruler (8) in FIG. 2*a*. As is well known, frets (9) divide the scale length of the guitar in accordance with a specific mathematical formula. Such frets (9) are typically metal strips (usually nickel alloy or stainless steel) and run parallel to each other and to nut (21) along fret board (11). If a string (16) is not being pressed against a fret (9), such string's vibrating length is determined by the distance between bridge (18) and nut (21). Pressing a string against a fret (9) changes the string's vibrating length for such string and therefore its resultant pitch (i.e. in a manner of speaking, such fret "becomes" the "nut" for the string being pressed).

Figure 3A:
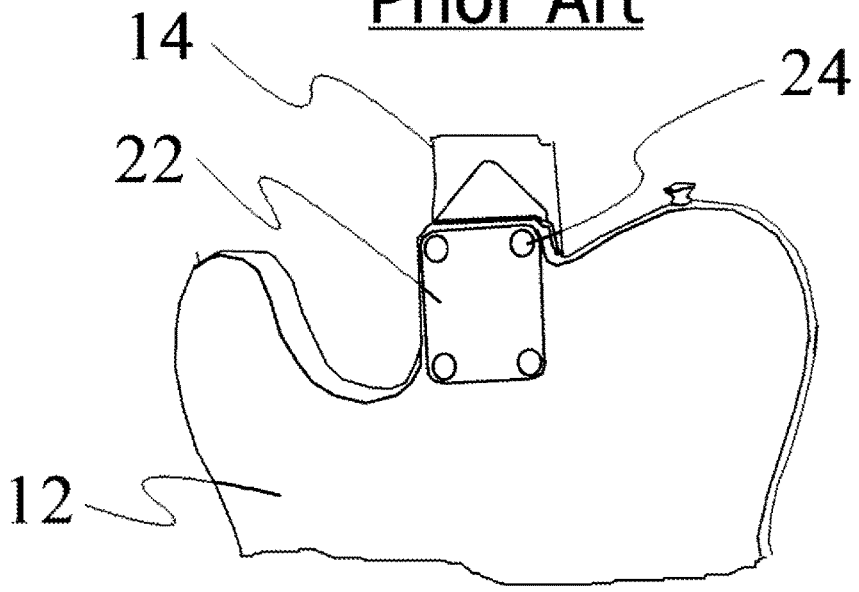
FIG. 3*a* is a close up view of the back-plate depicted in FIG. 2.

Referring to FIG. 2 and FIG. 3*a*, prior art guitar (10) further comprises a back-plate (22) mechanically associated, using attachment mechanisms (24), with the back side of body assembly (12). For such prior art guitars, attachment mechanisms (24) are typically wood screws and are long enough to further mechanically associate neck assembly (14) to body assembly (12) at neck-body interface (13, FIG. 1). As noted above, the association of the neck assembly (14) and body assembly (12), and there associated components, generally determine devices "string action" or the distance between the strings (16) and the frets (9) (for instruments having frets) and fingerboard (11) for guitars not having frets). Musicians will choose to have the instrument's string action set to different heights depending on the type of music being played or playing style favored.

Figure 3B:
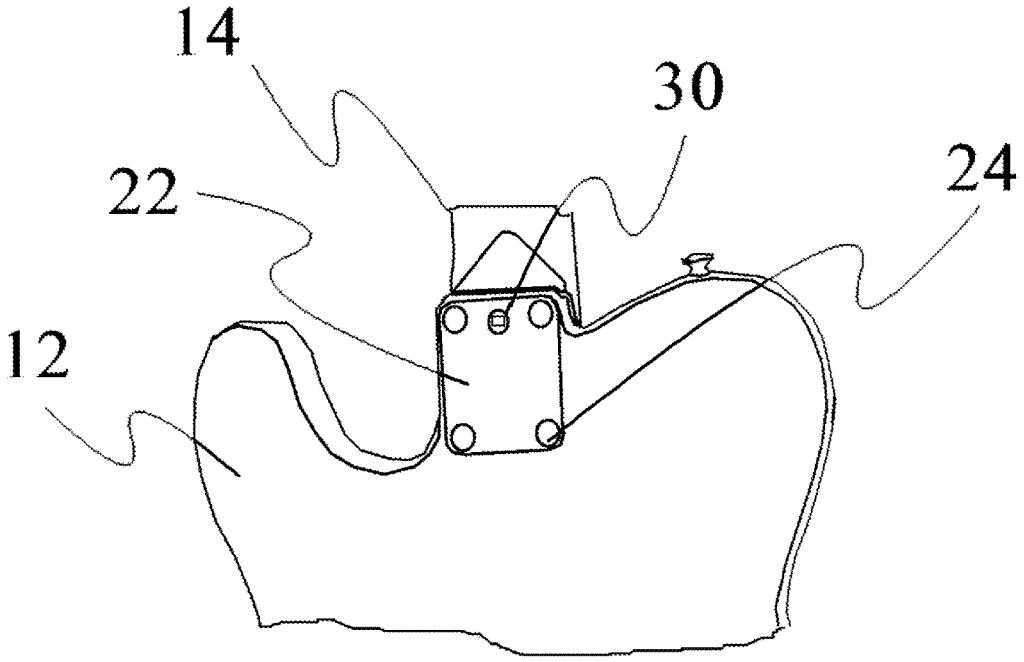
FIG. 3*b* is a close up view of the back-plate and adjustment mechanism according to one embodiment of the invention.

Referring now to FIG. 3*b*, the back view of one embodiment of a stringed instrument (10) according to one embodiment of the invention is presented. For guitar (10), an action adjustment (30) is provided. For the current embodiment, action adjustment (30) is a simple socket head cap screw, although any suitable technology may be used. As will be described in detail below, for the currently preferred embodiment of the invention, action adjustment (30) provides one adjustment point for quickly and simultaneously adjusting the action (23) of all strings while maintaining proper stability and alignment of the neck, and therefore proper alignment of the strings relative to fret board (11).

Figure 4A:
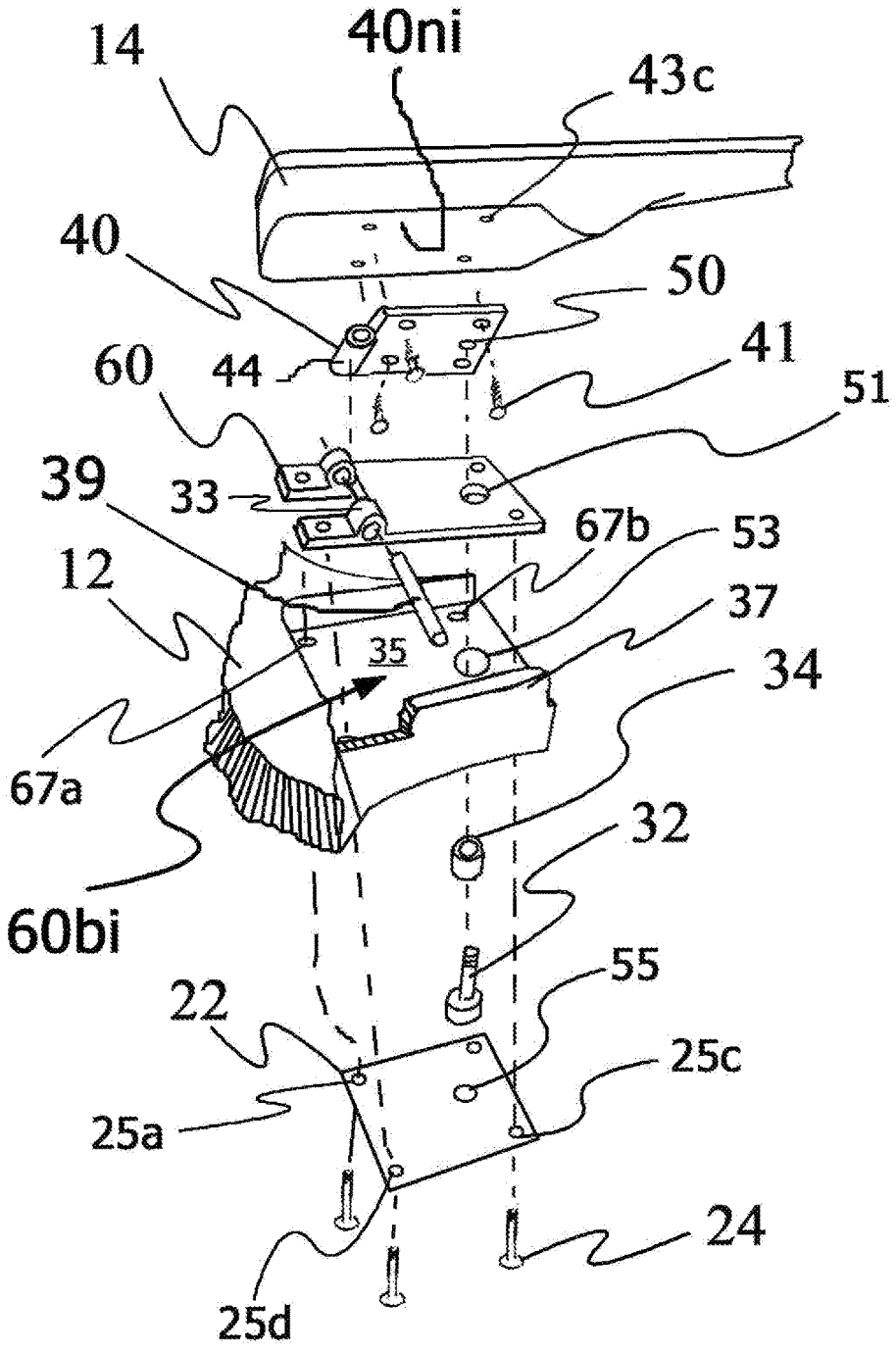
FIG. 4*a* is an exploded view of one possible embodiment of the invention showing a neck-plate, body-plate, pivot member, adjustment mechanism and modified back-plate.

Referring now to FIG. 4*a*, an exploded view of an adjustable neck-body interface (13, FIG. 1) according to one exemplary embodiment of the invention is presented for movably associating two components. As depicted in FIG. 4*a*, the first component is neck assembly (14) and the second component is body assembly (12). Body assembly (12) defines one possible embodiment for a body interface (60*bi*) (i.e. second-component-interface) comprising a rectangular flat surface (35), two opposing perpendicularly extending side walls (37), a perpendicularly extending back wall with no opposing wall. For such currently preferred embodiment, sidewalls (37) extend from the back wall to the opposing edge of body interface (60*bi*) thereby defining a three sided, open box configuration having a predefined body interface depth (the distance from flat surface (35) to the top edge of side walls (37). For the current embodiment, such body interface depth is preferably just less than the thickness of neck assembly (14) plus the thickness of neck-plate (40) (a first plate) plus the thickness of body-plate (60) (a second plate) so that the front surface of neck assembly (14) (i.e. the fret board surface) is slightly higher than the front surface of body assembly (12) when neck assembly (14) is associated with body assembly (12) (see FIG. 4*b*).

For the currently preferred embodiment, the perimeter of flat surface (35) defines a rectangle, although one of ordinary skill in the art will appreciate that the perimeter of flat surface (35) may define any geometric figure without departing from the scope and spirit of the invention. Body interface (60*bi*) further defines a plurality of openings called body holes (67*a*-67*d*) that extend from flat surface (35), through body assembly (12) to the back surface of body assembly (12). As shown in FIG. 4*a*, one body hole is defined at each corner of flat surface (35). Similarly, a body access port (53) extends from flat surface (35), through body assembly (12), and to the back surface of body 12, and is disposed at the approximate center point between opposing side walls (37) and at a point distal from the back wall.

Similarly, neck assembly (14) defines neck interface (40*ni*) on the back side and at the first end of neck assembly (14). Interface (40*ni*) comprises a flat surface with four openings there through thereby defining neck-interface-holes (43) configured to receive attachment mechanisms (41). For the current embodiment, neck-interface-holes (43) do not extend all the way through neck assembly (14). Neck-plate (40), discussed in detail later, is mechanically associated with neck interface (40*ni*), using attachment mechanisms (41). For the current embodiment, attachment mechanisms (41) are wood screws and are suitably sized so that they do not extend all the way through neck assembly (14).

Referring now to pivot member receiver (44), (which is one possible embodiment of a first pivot member receiver), defined by neck-plate (40), such pivot member receiver (44) is configured to be inserted between the two pivot member receivers (33, FIG. 4*a* and FIG. 5*a*, which are one possible embodiment of a second pivot member receiver) defined by body-plate (60) (please note the body-plate my define any number of pivot member receivers including only one). With pivot member receiver (44) inserted between the two pivot member receivers (33), pivot member (39) is inserted through pivot member receiver (33*a*) (i.e. in vertical alignment), through pivot member receiver (44), and press fitted into pivot member receiver (33*b*) thereby moveably and rotatably associating neck-plate (40) with body-plate (60). Additionally, when pivot member (39) is inserted into pivot member receivers (44) and (33) as described above, and the surfaces of neck-plate (40) is substantially horizontal to the surfaces of body-plate (60), body plate access port (51) is in alignment with the adjustment receiver (50) (one possible embodiment of an adjustment mechanism receiver) defined by neck-plate (40). For one alternative embodiment, pivot member (39) is threaded and at least one pivot member receiver is configured for removably receiving such threads. Suitable embodiments of a pivot member include rods, screws, bolts, shoulder bolts, cap screws, and pins.

It should be further appreciated that neck-plate (40), body-plate (60), and pivot member (39) may be incorporated into an integral device where pivot member (39) is not easily removed. For the purposes of this document, examples of something that is "not easily removed" include having to: (a) remove a weld; (b) cut a component; and (c) break a component. In contrast, examples of something that is "easily removed" include items that may be removed using ones fingers alone or in conjunction with a tool such as a screw driver, wrench, and/or a nut driver.

Next, using one of the methods described above, neck interface (40*ni*) (associated with neck-plate (40)) is associated with body interface (60*bi*) (which is associated with a body-plate (60)) so that body-plate access port (51) is in alignment with body access port (53) and body-plate holes (62*a*-62*d*, FIG. 5) are in alignment with body holes (67*a*-67*d*). It should be appreciated that for the currently preferred embodiment, body-plate holes (62*a*-62*d*) are threaded holes configured to receive a machine screw. Additionally, such body-plate holes (62*a*-62*d*) may go completely through body-plate (60) or only partially through body-plate (60).

Next, a spacer (34) and action adjustment mechanism (32) is inserted into body access port (53). For the preferred embodiment, spacer (34) defines a hollow cylinder defining no threads with an outside diameter that is slightly less than the diameter of body access port (53). One suitable alternative embodiment of spacer (34) is a bushing defining external wood threads as will be discussed later. It should be appreciated that "wood threads" are threads designed to be removably associated with, and screwed into a material such as wood while "machine screw threads" are male threads configured to be received by a component defining female threads.

Generally speaking, action adjustment mechanism (32), for example, preferably comprises a shaft portion defining a first free end and an opposing second end associated with a head portion wherein the free end of said shaft portion defines a first structure suitable for being received by a second structure defined by the adjustment mechanism receiver (50). Such first structure and second structure converts rotational movement of the action adjustment mechanism (32) to linear movement of the adjustment mechanism receiver (50). One possible embodiment of such first structure is a male thread and one possible embodiment of such second structure is a female thread.

One of ordinary skill in the art will appreciate that the above configuration allows action adjustment mechanism (32) to rotate (i.e. rotational movement) while preventing substantially all linear movement of adjustment mechanism (32) (i.e. action adjustment mechanism (32) simply rotates inside body access port (53)). Additionally, such rotational movement of action adjustment mechanism (32) is converted to linear movement by adjustment mechanism receiver (50) (as it moves up/down the male threads). Such movements result in linear movement of neck-plate (40) relative to body-plate (60) which changes the guitar's (10) string action (23) without substantially affecting the guitars pick action (the height between the strings and the sound board/body of a guitar).

One suitable embodiment of an action adjustment mechanism (32) is a socket head cap screw comprising a shaft portion defining machine threads at one end and cylindrical screw head at the opposing end. The shaft portion has an outer diameter that is smaller than the inner diameter of the spacer (34) so that the shaft portion by be inserted into and through said spacer (34). The machine threads defined by the shaft portion of action adjustment mechanism (32) are suitably configured for being associated with adjustment receiver (50) which defines female threads. The bolt head of action adjustment mechanism (32) defines a cylinder having an outer diameter that is slightly less than the diameter of body access port (53) so that it may be inserted into body access port (53). In contrast, the outer diameter of such bolt head is greater than the inter diameter of spacer (34) so that the bolt head (i.e. the head portion) may not pass through spacer (34).

For embodiments where spacer (34) is a simple hollow cylinder or washer, with the spacer (34) inserted into body access port (53), adjustment mechanism (32) is inserted into body access port (53) so that the shaft portion of action adjustment mechanism (32) is inserted through spacer (34), through body-plate access port (51), and screwed into adjustment receiver (50). For embodiments where spacer (34) defines a threaded component (such as a bushing defining external wood threads), the spacer (34) is screwed into body access port (53) a predefined distance. The shaft portion of action adjustment mechanism (32) is inserted through spacer (34), through body-plate access port (51), and screwed into adjustment receiver (50) so that the top surface of action adjustment mechanism (32) (i.e. the free surface of the head portion) is substantially flush with the back surface of body-assembly (12).

Next, back-plate (22) is mechanically associated with the back side of body assembly (12) thereby "trapping" action adjustment mechanism (32) inside body access port (53). Back-plate (22) is positioned on the back side of body assembly (12) so that back-plate holes (25*a*-25*d*) are in alignment with the body holes (67*a*-67*d*), respectively. Attachment mechanisms (24) are then inserted through each back-plate hole and body hole pair and screwed into its corresponding body-plate hole (62). Thus, attachment mechanisms (24) thereby basically "sandwiches" the body interface (60*bi*) between body-plate (60) and back-plate (22) thereby securely, movably, removably (i.e. "easily removable"), and adjustably associating neck assembly (14) to body assembly (12).

As depicted in FIG. 4*a*, back-plate access port (55) defines a hole having a diameter smaller than the outside diameter of the bolt head of action adjustment mechanism (32) so that back-plate (22) secures action adjustment mechanism (32) within body access port (53). Thus, it should be noted that back-plate access port (55) will be in alignment with the bolt head of action adjustment mechanism (32) thereby allowing a tool to be inserted through said back-plate access port (55) to rotate action adjustment mechanism (32). Such rotation is converted to linear movement by the adjustment mechanism receiver, and thus, causes neck-plate (40) to move either toward or away from body-plate (60) (depending on the direction of rotation of action adjustment mechanism (32)) thereby adjusting the guitar's (10) string action (23, FIG. 2*a*) while having minimal effects on the pick action. For the purposes of this document, "minimal effects" as to pick action is a change of less than 10 percent and "extreme minimal effects" is less than 1 percent. Consequently, back-plate access port (55) has a diameter large enough so that a tool may be associated with action adjustment mechanism (32) and a diameter small enough (i.e. smaller than the outside diameter of the bold head) so as to secure action adjustment mechanism (32) at least partially within access port (55).

It should be appreciated that alternative embodiments where action adjustment mechanism (32) comprises a "screw or bolt head" that does not require a tool to be turned may be used without departing from the scope and spirit of the invention. One example of such a device is a wing bolt.

One of ordinary skill in the art will further appreciate that there are various configurations that may be used for an action adjustment mechanism (32). For example, some guitars may not have a back-plate (22). For such guitar's, a back-plate may be provided or the guitar (10) may simply not include a back plate.

Figure 9A:
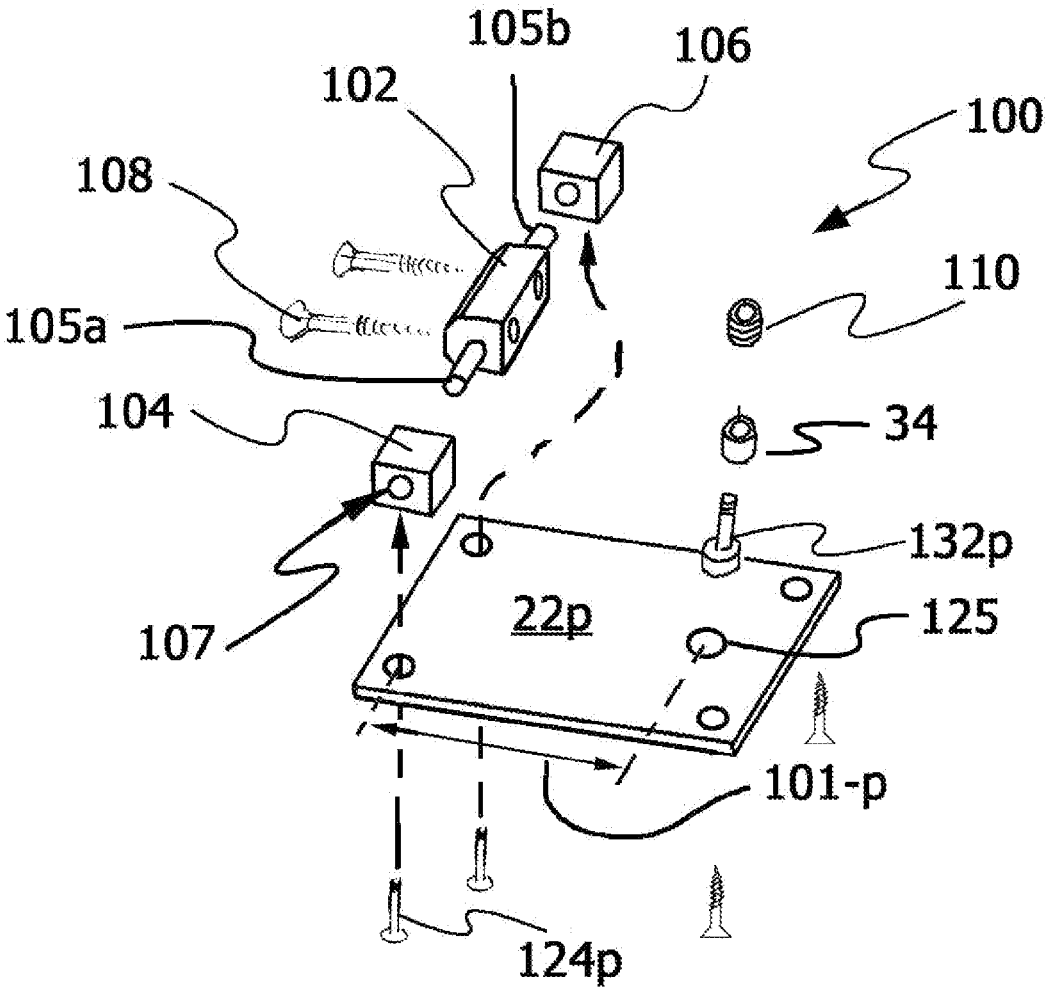
FIG. 9*a* is an elevated exploded perspective view of an alternative embodiment of the invention comprising a pintle block, two pillow blocks, associated hardware, and a guitar back-plate.

Alternatively, when no back-plate is desired and additional spacer may be used to secure action adjustment mechanism (32) within body access port (53). For example, the second spacer would be a bushing defining external wood threads (as described above). For such a configuration, action adjustment mechanism (32) is inserted through the various access ports and then screwed into adjustment receiver (50). Next, once the adjustment mechanism (32) has inserted into body access port (53), a threaded bushing, similar threaded insert (110) depicted in FIG. 9*a*, is screwed into body access port (53) to secure the action adjustment mechanism in place.

Any suitable technology may be used as an action adjustment mechanism (32); including devices that do not require a tool to adjust including cylindrically shaped knurled thumb bolts and cylindrically shaped wing bolts preferably with folding wings. Additionally, one of ordinary skill in the art will appreciate that for one possible alternative embodiment, neck-plate (40) defines a bolt (defining male threads) and the action adjustment mechanism (32) is a threaded device defining female threads (such as a nut, wing nut, thumb nut). For such embodiments, the action adjustment mechanism (32) may comprise a pointer configured to point to a measurement defined on the back surface of back-plate (22) to indicate a current "action" amount.

Figure 4B:
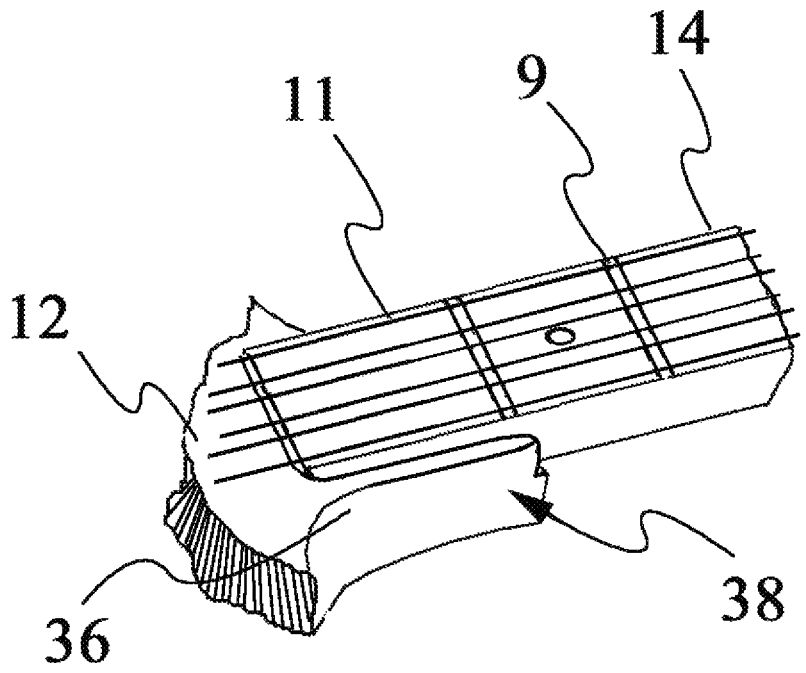
FIG. 4*b* is a side elevated perspective view of guitar body and neck associated using the components of FIG. 4*a;*

FIG. 4*b* presents a close-up view of neck assembly (14) mechanically associated with body assembly (12) according to certain embodiments of the invention identified above (i.e. FIG. 4*a*). As can be seen in FIG. 4*b*, the front surface (fret board) of neck assembly (14) is slightly higher than the front surface of body assembly (12). Additionally, the outer surfaces (38) defined by side walls (37) of body interface (60*bi*) define body flanges (36) that hide neck-plate (40) and body-plate (60). Consequently, for such embodiment, there is no access to pivot member (39) when neck assembly (14) and body assembly (12) are associated as shown. Therefore, to remove the association between neck interface (40*ni*) and body interface (60*ni*), attachment mechanisms (24) are removed from body-plate (60). It should be appreciated that side wall (37)/flange (36) may define a hole that is in alignment with a pivot member (39) when neck assembly (14) is associated with body assembly (12) thereby providing access to such pivot member (39) allowing the association between neck assembly (14) and body assembly (12) to be removed without removing attachment mechanisms (24).

Figure 4C:
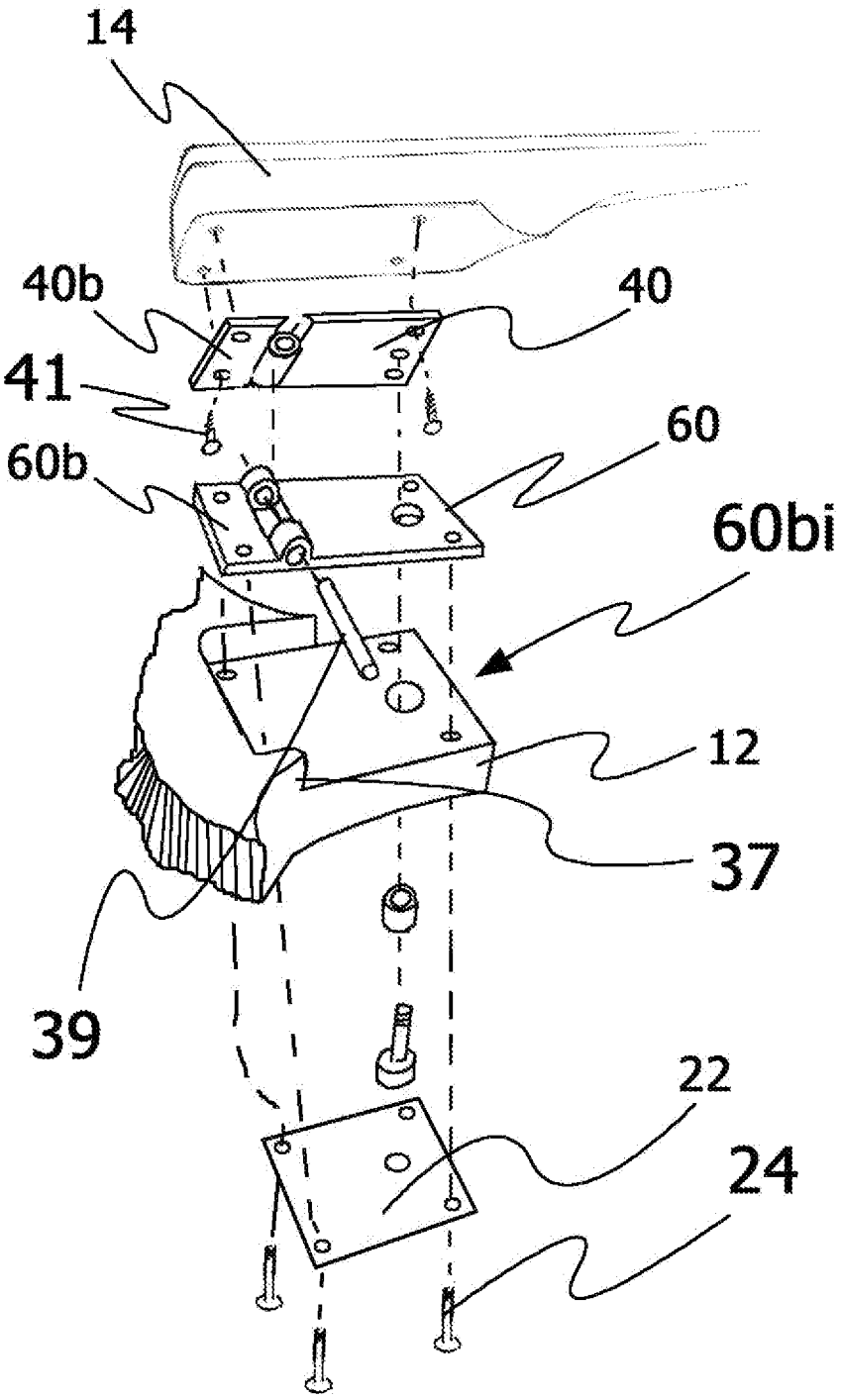
FIG. 4*c* is one possible alternative embodiment of the invention having a removable pivot member.

Referring now to FIG. 4*c*, one alternative embodiment of the invention is presented wherein access to pivot member (39) is provided when neck interface (40*ni*) is associated with body interface (60*ni*). For this currently preferred embodiment of the invention, side wall (37) of body interface (60*bi*) does not extend along the full length of the side of body interface (60*bi*) as was the case in the embodiments described above. Instead, for the current embodiment, the shortened side wall (37) of body interface (60*bi*) allows access to pivot member (39) when neck assembly (14) is associated with body assembly (12). Consequently, for such embodiment, pivot member (39) may be removed without removing attachment mechanisms (24) thereby allowing neck assembly (14) to be removed from its association with body assembly (12) without removing attachment mechanisms (24). Notably, for such configuration, body-plate (60) may be associated with body interface (60*bi*) using attachment mechanisms similar or identical to attachment mechanisms (41) (i.e. wood screws instead of machine screws).

For one possible alternative embodiment, attachment mechanisms (24) are machine screws which pass through clearance holes defined by the back-plate (22) and body interface (60*bi*) and into the threaded holes defined by body-plate (60). Notably, any combination of internal wood screws/machine screws and external machine screws/wood screws may be used for attachment mechanism (24) ("internal" means not accessible after the two components have been associated with each other, and "external" means accessible after the two components have been associated with each other). Additionally, any suitable fastener other than screws and bolts may be used.

Referring again to FIG. 4*c*, one will notice that neck-plate (40) and body-plate (60) are slightly different than in the configuration depicted in FIG. 4*a*. More specifically, neck-plate (40) is configured with an extension (40*b*). Additionally, body-plate (60) comprises a continuous extension (60*b*) as opposed to the notched extension of the previous embodiment. Such changes simply represent possible alternative neck-plate and body-plate embodiments.

Body-Plate

Figure 5A:
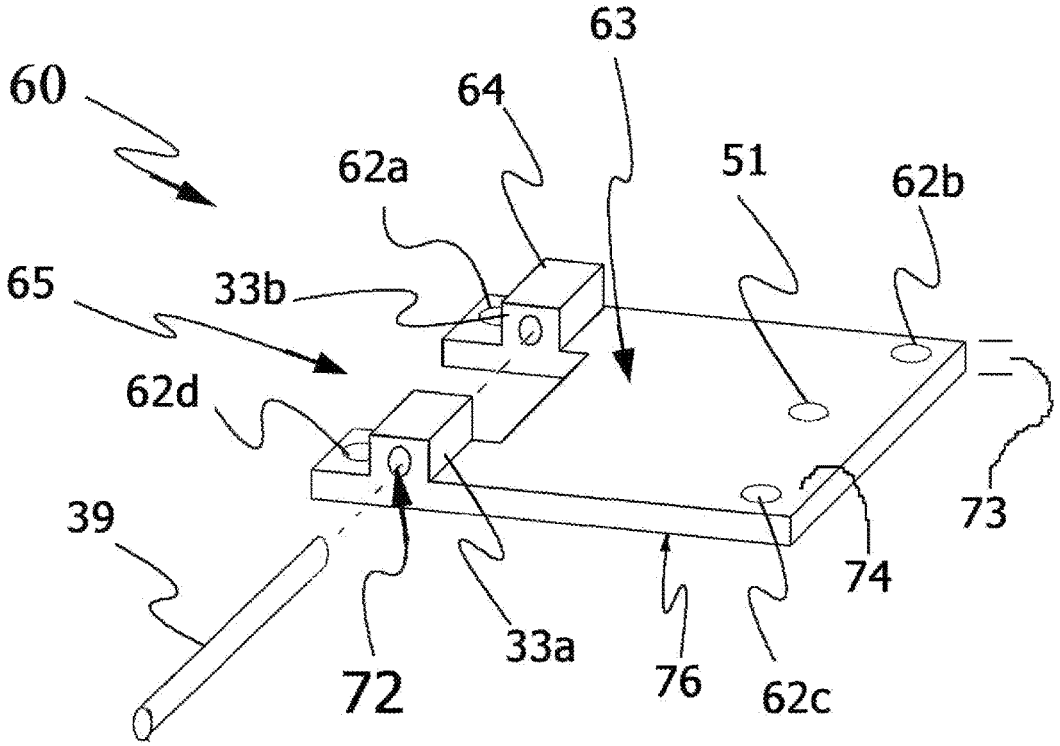
FIG. 5*a* is a side perspective view of an exemplary body-plate.
Figure 5B:
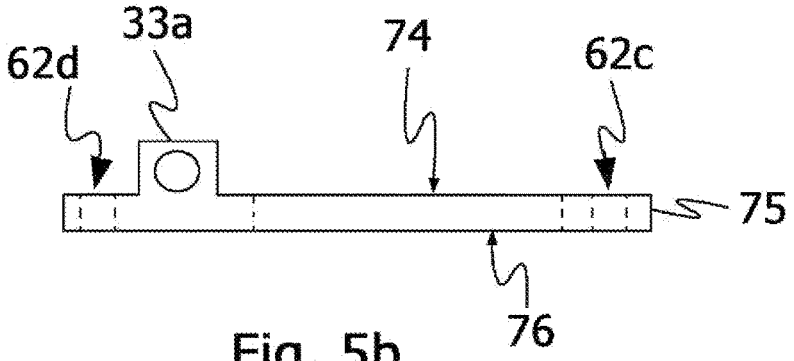
FIG. 5*b* is a side elevational view of the body-plate depicted in FIG. 5*a;*
Figure 5C:
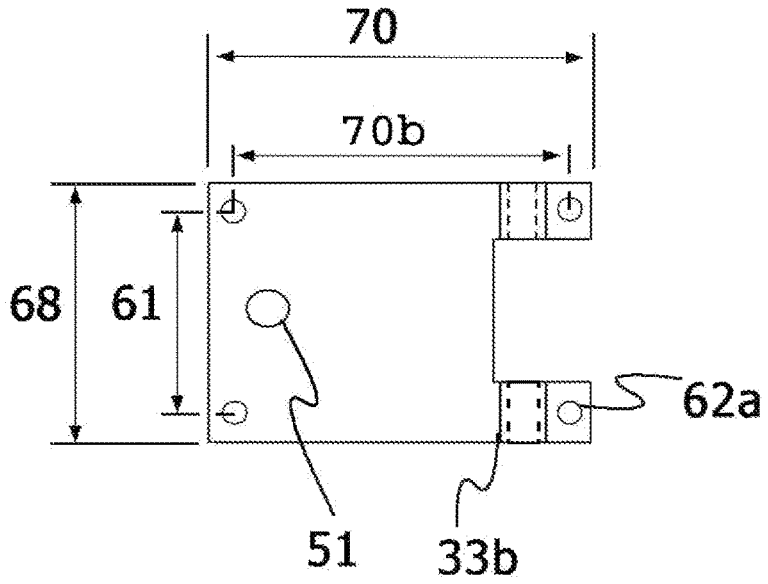
FIG. 5*c* is a top plan view of the body-plate depicted in FIG. 5*a;*
Figure 5D:
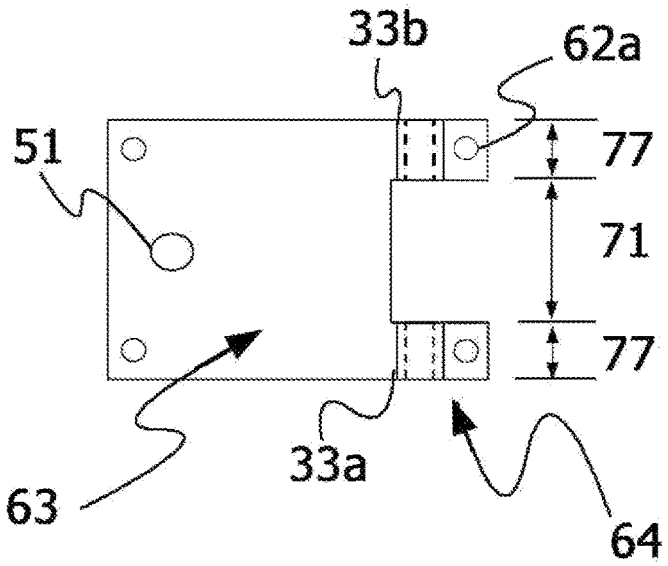
FIG. 5*d* is a bottom plan view of the body-plate depicted in FIG. 5*a;*

Referring now to FIG. 5*a* through 5*d*, one exemplary embodiment of a body-plate (60) is present, which is one possible embodiment of a "second plate". For the currently preferred embodiment, body-plate (60) comprises a plate portion (63) and two perpendicularly extending pivot member receivers (33*a*) and (33*b*) (collectively referred to as pivot member receivers (33)) disposed at opposing peripheral edges of body-plate (60). As best seen in FIGS. 5*a* and 5*c*, the perimeter of plate portion (63) defines a pair of generally rectangular opposed surfaces, top surface (74) and bottom surface (76) having a width (68) and a length (70), and wherein each said surface defines a substantially flat plane, each said plane being substantially parallel to the other and wherein said plate portion (63) further defines a peripheral edge (75) connecting said opposed surfaces and defining thickness (73). Pivot member receivers (33) are disposed at opposing corners of top surface (74) and between opposing body-plate holes (62, described below). Plate portion (63) further defines notch region (65) at one end of said opposed surfaces separating the two pivot member receivers (33).

Body-plate (60) further defines a plurality of openings there through connecting top surface (74) to bottom surface (76) wherein such openings define a plurality of body-plate holes (62*a* through 62*d*). Body-plate holes (62*a*) through (62*d*) (collectively referred to as body-plate holes (62)) are disposed at the approximate corners of the top surface (74) thereby defining a body plate hole pattern. For the current embodiment, body-plate holes (62) are threaded and are configured to receive machine screws (such holes may be referred to as threaded-holes, see attachment mechanism (24) of FIG. 4*c*). It should be noted that body-plate holes 62 may or may not extend completely through body-plate (60).

As noted above, pivot member receivers (33*a*) and (33*b*) are disposed at opposing corners of top surface (74). Pivot member receiver (33*a*) is disposed at a first top surface corner between body-plate hole (62*d*) and body-plate hole (62*c*). Similarly, pivot member receiver (33*b*) is disposed at an opposing second top surface corner between body-plate hole (62*a*) and body-plate hole (62*b*). Each pivot member receiver (33) comprises a rectangular block defining a cylindrical pivot member receiver hole (72) at the approximate center.

For the current embodiment, pivot member receiver (33*a*) is an unthreaded hole and pivot member receiver (33*b*) defines a hole that is at least partially threaded (i.e. an at least partially threaded hole). As depicted in FIG. 5*a*, Pivot member receivers (33) extend perpendicularly from top surface (74) so that each pivot member receiver hole (72) is in the horizontal and vertical alignment with each other when receiving a pivot member.

As noted above, plate portion (63) further defines notch region (65) at one end of said opposed surfaces separating the two pivot member receivers (33). Such notch region (65) defines a notch gap width (71) suitably sized to receive a pivot member receiver (44) defined by neck-plate (40) as described later.

Body-Plate Hole Pattern

As best seen in FIG. 5*c*, and as noted above, body-plate (60) comprises a plate portion (63) where the perimeter of plate portion (63) defines a pair generally rectangular surfaces; top surface (74) and bottom surface (76) having a width (68) and a length (70) separated by a thickness (73). One of ordinary skill in the art will appreciate that, for some embodiments, the maximum values for width (68) and length (70) are determined by the dimensions of flat surface (35) of body interface (60*bi*) (or vice versa depending on the device). In any event, the perimeter of plate portion (63) is suitably sized to be received by flat surface (35).

Similarly, for embodiments where guitar (10) has a back-plate (22), the back plate hole pattern is preferably equivalent to the body plate hole pattern which are each equivalent to the body interface hole pattern. Such a configuration allows the body-plate (60) and back-plate (22) to be secured to body assembly (12) using the same bolt holes and attachment mechanisms. For embodiments of the invention that define a retrofit kit for existing guitars (10), such a configuration allows the original hole pattern to be used to secure body-plate (60) to the body interface using the original holes thereby eliminating the need to drill additional holes.

Consequently, for the currently preferred embodiment body-plate holes (62*a*) and (62*b*) are disposed at two opposing corners along the long side (if there is a "long" side) of top surface (74) defining a length-side-hole distance (70*b*) that is substantially equal to the same measurement for the corresponding holes defined by back-plate (22). Additionally, body-plate holes (62*b*) and (62*c*) are disposed at two opposing corners along the short side (if there is a "short" side) of top surface (74) defining a width-side-hole distance (61) that is substantially equal to the same measurement for the corresponding holes defined by back-plate (22).

As noted above, for removable pivot member (39) configurations, attachment devices (41) may be used to associate body-plate (60) with body interface (60*bi*). Such attachment devices (41) may be wood screws, for example, inserted into counter sunk body-plate holes (62), and screwed into the body interface from the top surface toward the bottom surface. For such a configuration, it is not important if the hole pattern defined by body-plate (60) matches the hole pattern defined by back-plate (22).

Neck-Plate

Referring now to FIG. 6*a* through FIG. 6*d*, one exemplary embodiment of a neck-plate (40) is presented. Neck-plate (40) comprises a plate portion (42) and a pivot member receiver (44) portion. Preferably, the perimeter edge of plate portion (42) defines a geometric figure similar to the geometric figure defined by body-plate (60) (i.e. a rectangular shape as described above). However, it will be appreciated that plate portion (42) may define any geometric figure without departing from the scope of the present invention. For the current embodiment, plate portion (42) defines a rectangle that is similar in size and thickness to the rectangle defined by body-plate (60).

As described above for body-plate (60), the perimeter of plate portion (42) defines a pair of generally rectangular opposed surfaces, top surface (42*a*) and bottom surface (42*b*), having a width (54) and a length (52), and wherein each said surface defines a substantially flat plane, each said plane being substantially parallel to the other and wherein said plate portion (42) further defines a peripheral edge connecting said opposed surfaces and defining thickness (56). Pivot member receiver portion (44) is dispose along one side of plate portion (42) (described in detail below).

Neck-plate (40) further defines a plurality of openings there through thereby defining a plurality of neck-plate holes (48*a* through 48*d*) for mechanically associating the neck-plate to said neck assembly interface. Neck-plate holes (48*a*) through (48*d*) (collectively referred to as neck-plate holes (48)) are disposed at the approximate corners of Neck-plate (40) thereby defining a neck-plate hole pattern. For the current embodiment, neck-plate holes (48) are not threaded and are configured (beveled) to receive wood screws (attachment mechanisms (41)) so that the head of such wood screws will be substantially even with the surface of top surface (42*a*) when securing neck-plate (40) to neck assembly (14). Any suitable attachment mechanism (41) may be used to secure neck-plate (40) to neck assembly (14).

As noted above, pivot member receiver portion (44) is defined at one side of plate portion (42) and comprises a rectangular block defining a cylindrical pivot member receiver hole (46) at the approximate center (and slightly elevated). Pivot member receiver hole (46) runs the entire length of pivot member receiver portion (44). The height and width of each pivot member receiver portion (44) is preferably substantially equal to pivot member receivers (33). Similarly, the length of pivot member receiver portion (44) is just less than the length of notch region (65) so that pivot member receiver hole (46) is in the horizontal and vertical alignment with pivot member receiver hole (72) when pivot member receiver portion (44) is inserted into notch region (65) (see FIGS. 7*a* and 7*b*).

Neck-Plate Hole Pattern

Figure 6A:
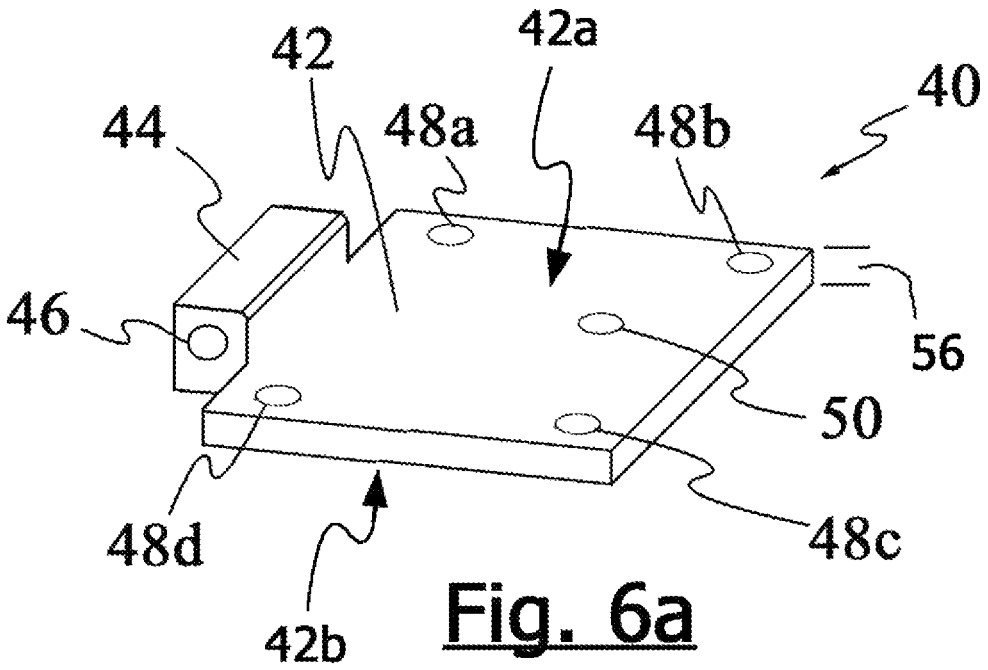
FIG. 6*a* is a side perspective view of an exemplary neck-plate.
Figure 6B:
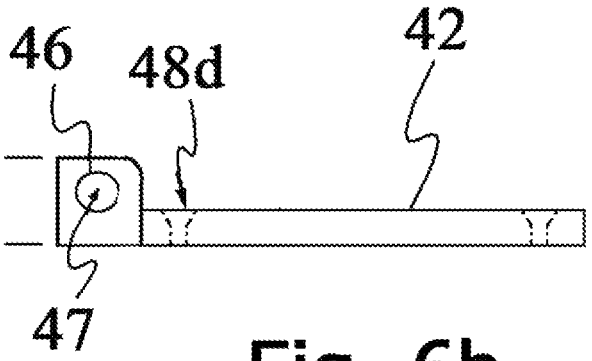
FIG. 6*b* is a side elevational view of the neck-plate depicted in FIG. 6*a;*
Figure 6C:
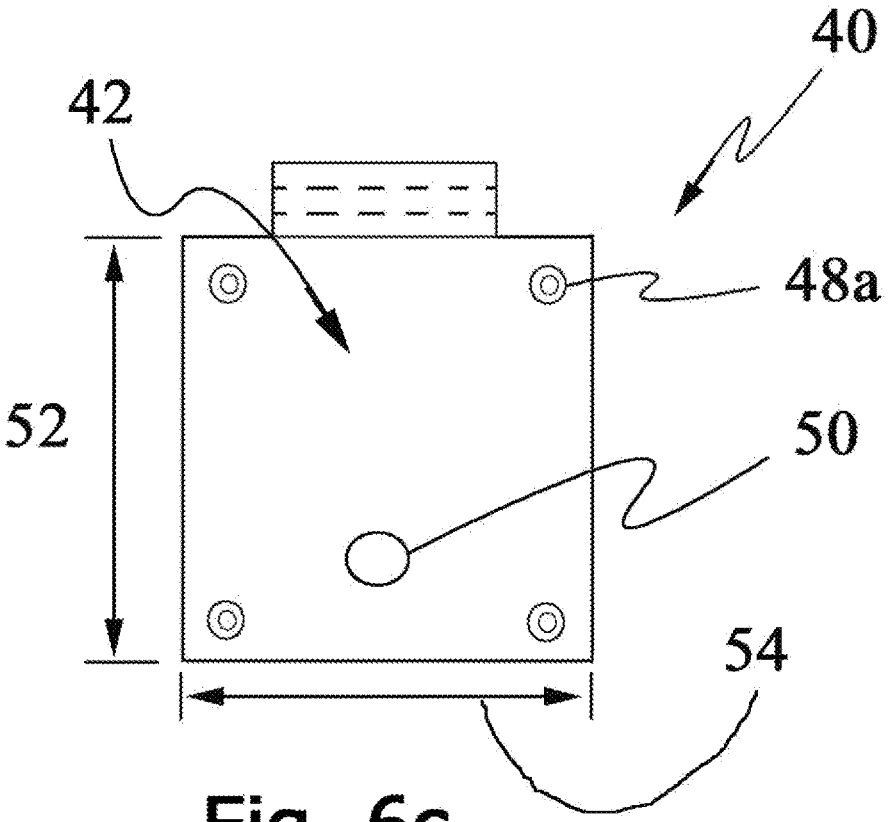
FIG. 6*c* is a top plan view of the neck-plate depicted in FIG. 6*a;*
Figure 6D:
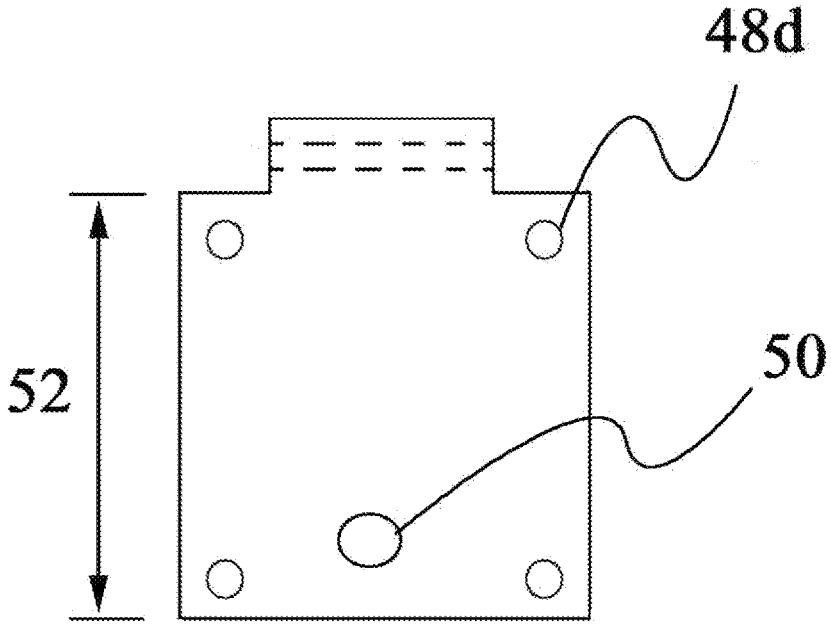
FIG. 6*d* is a bottom plan view of the neck-plate depicted in FIG. 6*a;*

As best seen in FIG. 6*c* and FIG. 6*d*, and as noted above, neck-plate (40) comprises a plate portion (42) where the perimeter of plate portion (42) defines a pair of generally rectangular opposed surfaces, top surface (42*a*) and bottom surface (42*b*), having a width (54) and a length (52) separated by a thickness (56). For the currently preferred embodiment, neck-plate portion width (54), neck-plate portion length (52), and neck-plate thickness (56) are substantially equal to body-plate width (68), body-plate length (70), and body-plate thickness (73) respectively. As noted above, neck-plate portion (42) defines a plurality of openings thereby defining holes (48*a*) through (48*d*) (referred collectively to as neck-plate holes (48)) with one hole being defined at each corner of neck-plate portion (42).

Figure 7B:
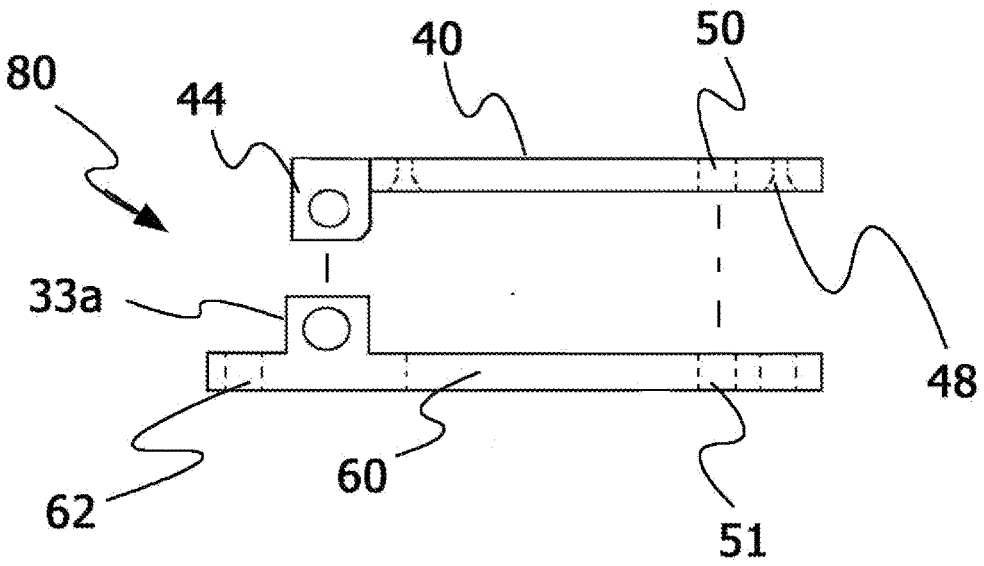
FIG. 7*b* is a side elevational view of a body-plate below (slightly out of vertical alignment) and in horizontal alignment with a neck-plate.
Figure 7A:
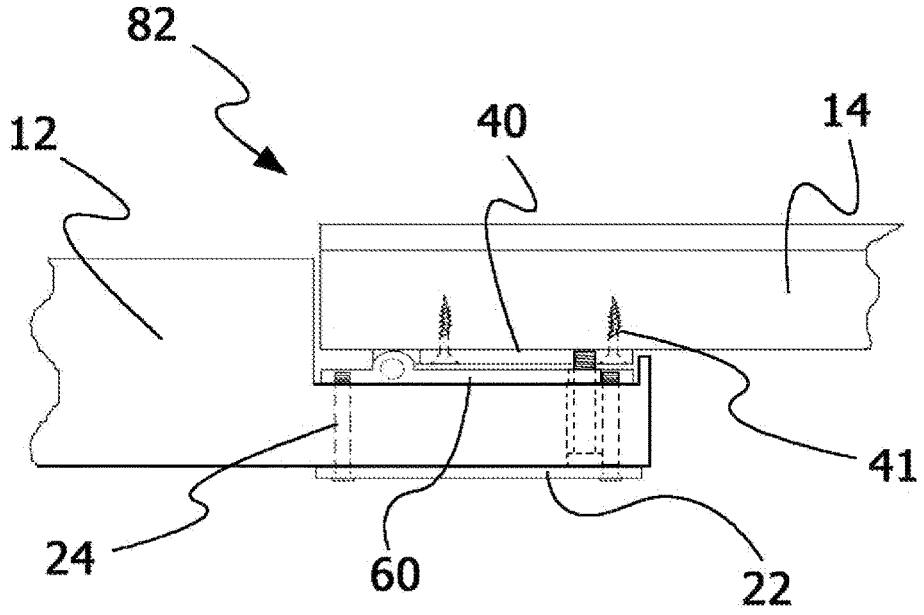
FIG. 7*a* shows a side elevational view of a guitar neck associated with a guitar body using a FIG. 5 body-plate and a FIG. 6 neck-plate.
Figure 7C:
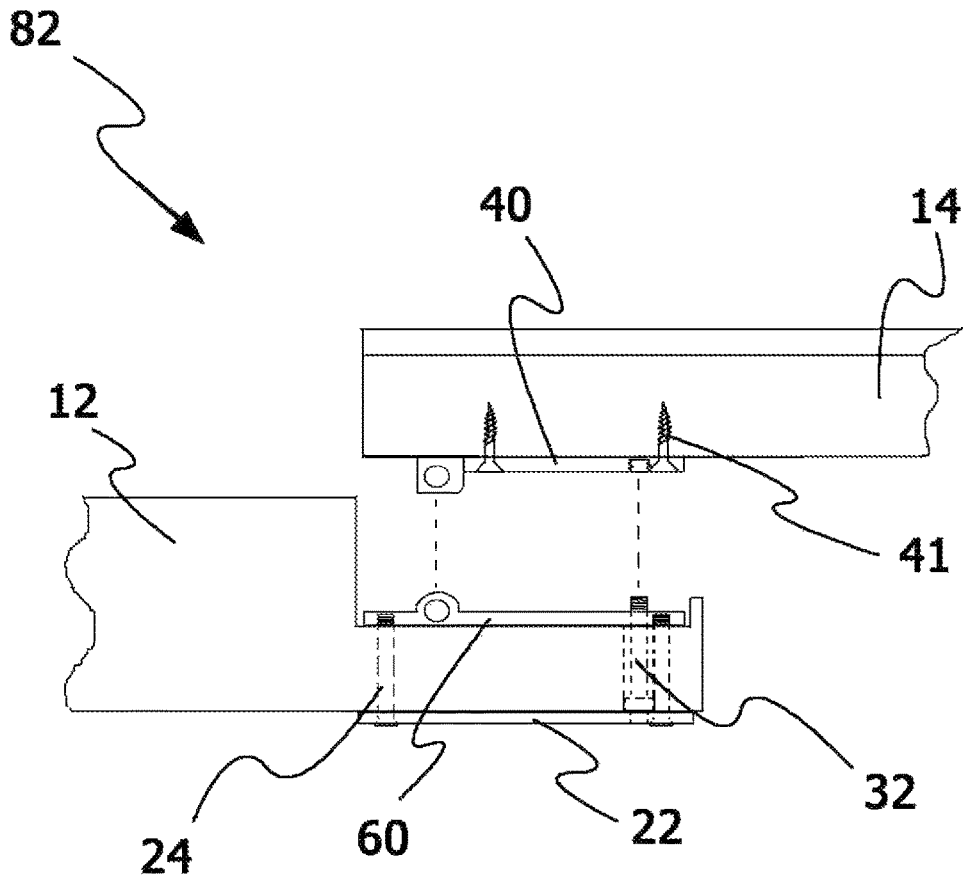
FIG. 7*c* is a partial exploded side elevational view of the device depicted in FIG. 7*a* in the horizontal alignment but slightly out of vertical alignment (i.e. exploded in the vertical direction)

Referring now to FIG. 7*a*, FIG. 7*b*, and FIG. 7*c*, one exemplary embodiment of the invention is presented wherein a body-plate (60) and neck-plate (40) are shown in horizontal and vertical alignment and associating a neck assembly (14) to a body assembly (12). Such a configuration presents one embodiment of a first plate (neck plate) defining a pair of opposed surfaces and suitably configured for being mechanically associated with a first component (neck assembly). The first plate defines a first pivot member receiver and an adjustment mechanism receiver. Additionally, a second plate (body plate) defines a pair of opposed surfaces and is suitably configured for being mechanically associated with a second component (body assembly). The body assembly defines an opening there through thereby defining a second-component-port. The second plate defines a second pivot member receiver and a plate-port, wherein said plate-port is in alignment with said second-component-port when said second plate is associated with said second component.

A pivot member suitably configured for being movably associated with said first pivot member receiver and said second pivot member receiver when said pivot member receivers are in alignment is further presented. Such a configuration movably associates the first plate with the second plate, and thus, movably associates the first component with the second component.

The first plate and second plate are suitably configured so that an adjustment mechanism receiver is in alignment with said plate-port and said second-component-port when said pivot member is being received by the first pivot member receiver and the second pivot member receiver. Finally, an adjustment mechanism suitably configured for being inserted into said second-component-port and through said plate-port and adjustably associated with said adjustment mechanism receiver is presented. Such a configuration allows the distance between adjacent surfaces of said first plate and said second plate to be varied by activating said adjustment mechanism thereby changing the distance between the first component and the second component. When the first component is a guitar neck and the second component is a guitar body, such adjustments alters the guitar's action.

More specifically, FIG. 7*b* shows an exemplary body-plate (60) underneath an exemplary neck-plate (40) separated for clarity but in the horizontal alignment whereas FIG. 7*a* shows body-plate (60) and neck-plate (40) in alignment and mechanically associating a neck assembly (14) with a body assembly (12). For such currently preferred configuration, attachment mechanisms (24) are machine screws. FIG. 7*c* shows a partially exploded view of such configuration.

Figure 8B:
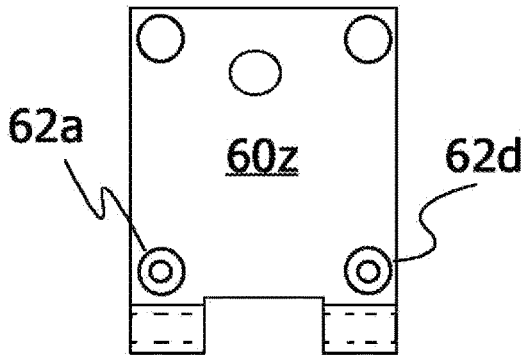
FIG. 8*b* is a top plan view of the body-plate of FIG. 8*a* wherein such body plate does not define holes beyond the pivot member receivers.
Figure 8C:
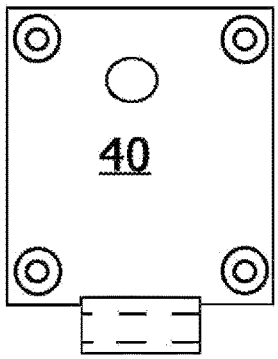
FIG. 8*c* is a bottom plan view of the neck-plate of FIG. 8*a;*
Figure 8A:
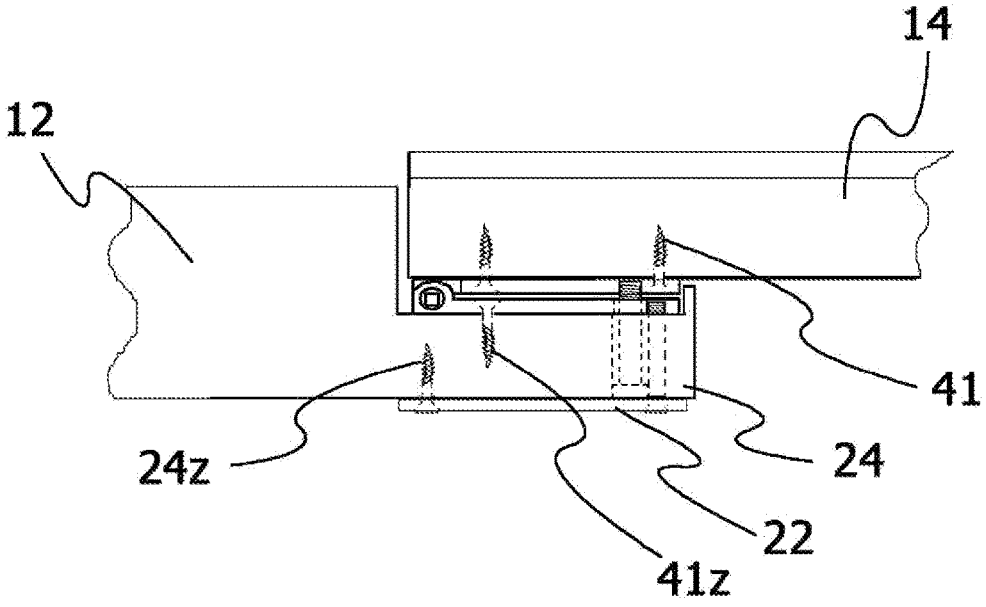
FIG. 8*a* is a side elevational view of one alternative embodiment of the invention showing two wood screws and two machine screws associating a body-plate with a guitar body.

Referring now to FIG. 8*a*, FIG. 8*b*, and FIG. 8*c*, one possible alternative embodiment of the invention is presented wherein a possible alternative body-plate (60*z*) embodiment is presented. For such currently preferred embodiment, as best seen in FIG. 8*b*, body-plate (60*z*) does not define hole extensions as in the previous embodiment for body-plate (60). Instead, holes (62*a*) and (62*d*) are disposed on the opposite side of pivot member receivers (33). Additionally, holes (62*a*) and (62*d*) define offset holes configured for receiving wood screws (41*a*) as described above for the holes defined by neck-plate (40).

As shown in FIG. 8*c*, for such embodiment, neck-plate (40) is the same as before. FIG. 8*a* presents a view of a neck assembly (14) associated with a body assembly (12) using such alternative embodiment. As can be seen in FIG. 8*a*, wood screws (41*z*) are used to secure body-plate (60*z*) to body assembly (12) for holes 62*a* and 62*d*. Similarly, holes 62*b* and 62*c* may define wood screw holes or they may define machine screw holes as depicted in FIG. 8*a* and FIG. 8*b*). For such embodiment of the invention, access to pivot member (39) is required when the neck assembly is associated with the body assembly.

Figure 11A:
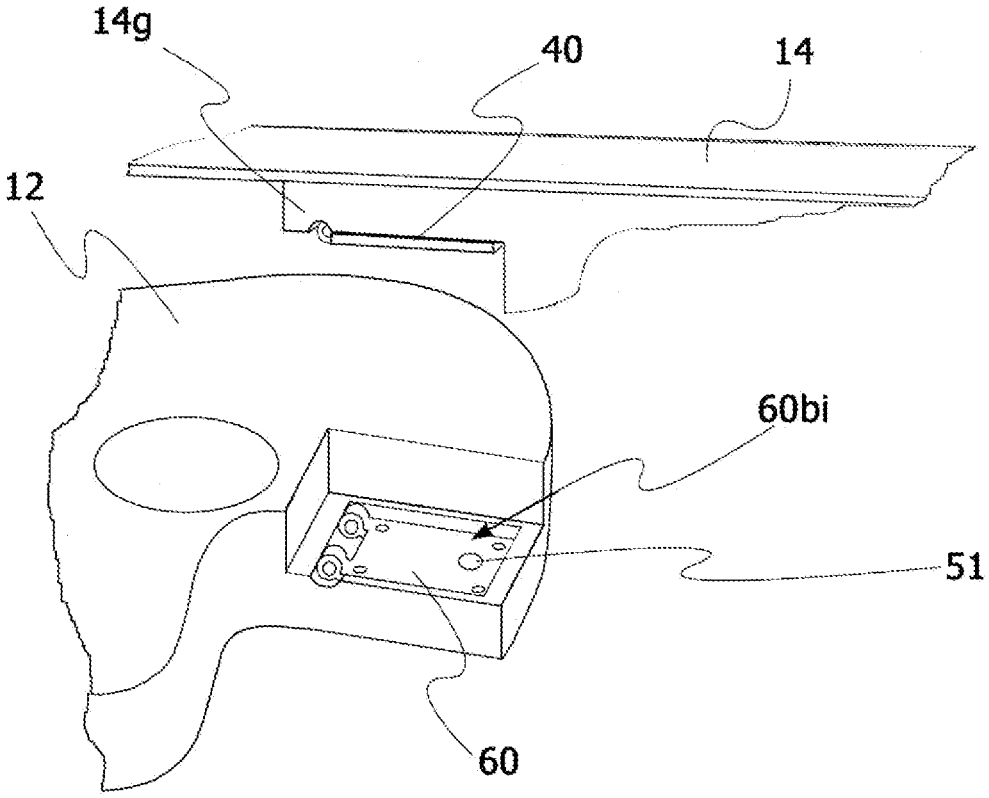
FIG. 11*a* is a side perspective elevated view of a guitar body and a guitar neck wherein the guitar body comprises a body interface defining a void suitably sized for receiving a body-plate and at least part of a neck-plate.
Figure 11B:
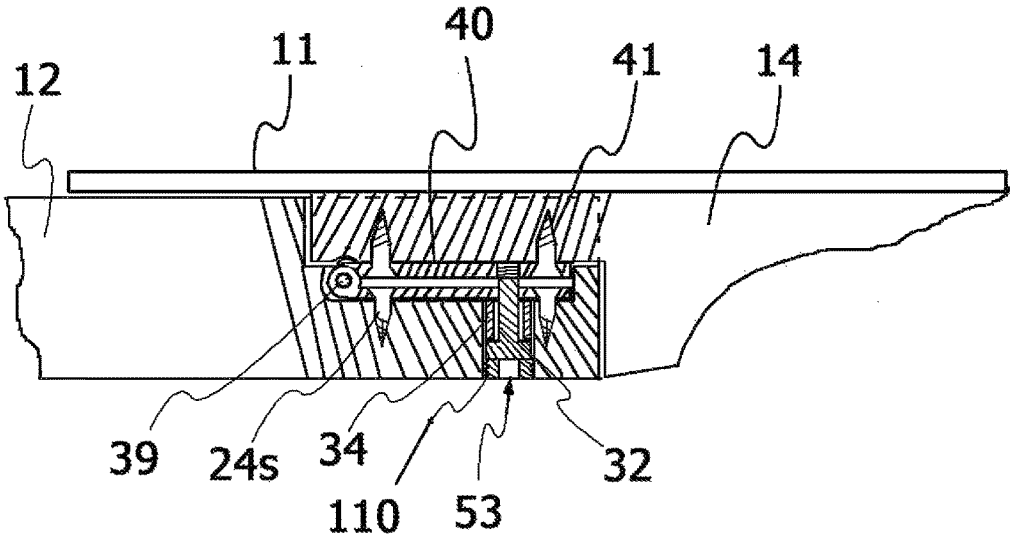
FIG. 11*b* is a side elevational view of a guitar body associated with a guitar neck according to the configuration depicted in FIG. 11*a*.

Referring now to FIG. 11*a* and FIG. 11*b*, another alternative embodiment of the invention is presented where back-plate (22) is not necessary. Additionally, access to pivot member (39) is provided as described above. Further, body interface (60*bi*) defines a recessed region suitably sized to receive body-plate (60) and at least part of neck-plate (40) thereby substantially hiding all of the combination of body-plate (60) and neck-plate (40) when the neck assembly is associated with the body assembly. As depicted in FIG. 11*a*, such recessed region is associated with a body-plate (60) and is sufficiently deep to further receive at least part of neck-plate (40). For such a configuration, as depicted in FIG. 11*b*, body-plate (60) and neck-plate (40) are associated with their respective body and neck interface using attachment mechanisms (24*s*) and (41), respectively, wherein such attachment mechanisms are wood screws. Notably, instead of using a back-plate (22) to secure the action adjustment mechanism (32) within access port (53), a hollow threaded insert (110) is used. Further, while optional, the neck interface may define a pivot member receiver groove (14*g*) depending on the configuration desired for a particular embodiment.

Pintle Adjuster

Figure 9B:
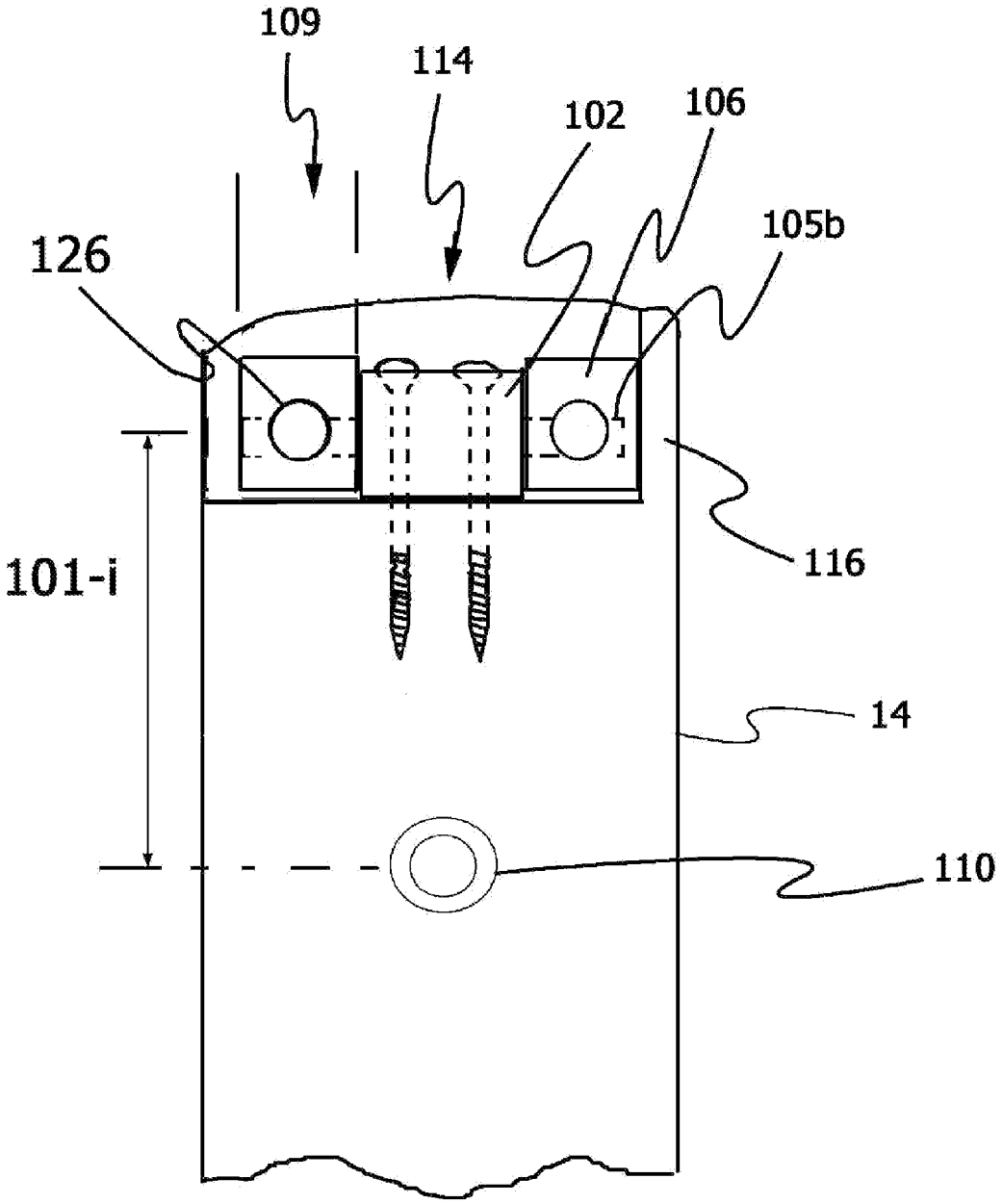
FIG. 9*b* is a bottom plan view of the pintle block and pillow blocks of FIG. 9*a* associated with a neck.
Figure 9C:
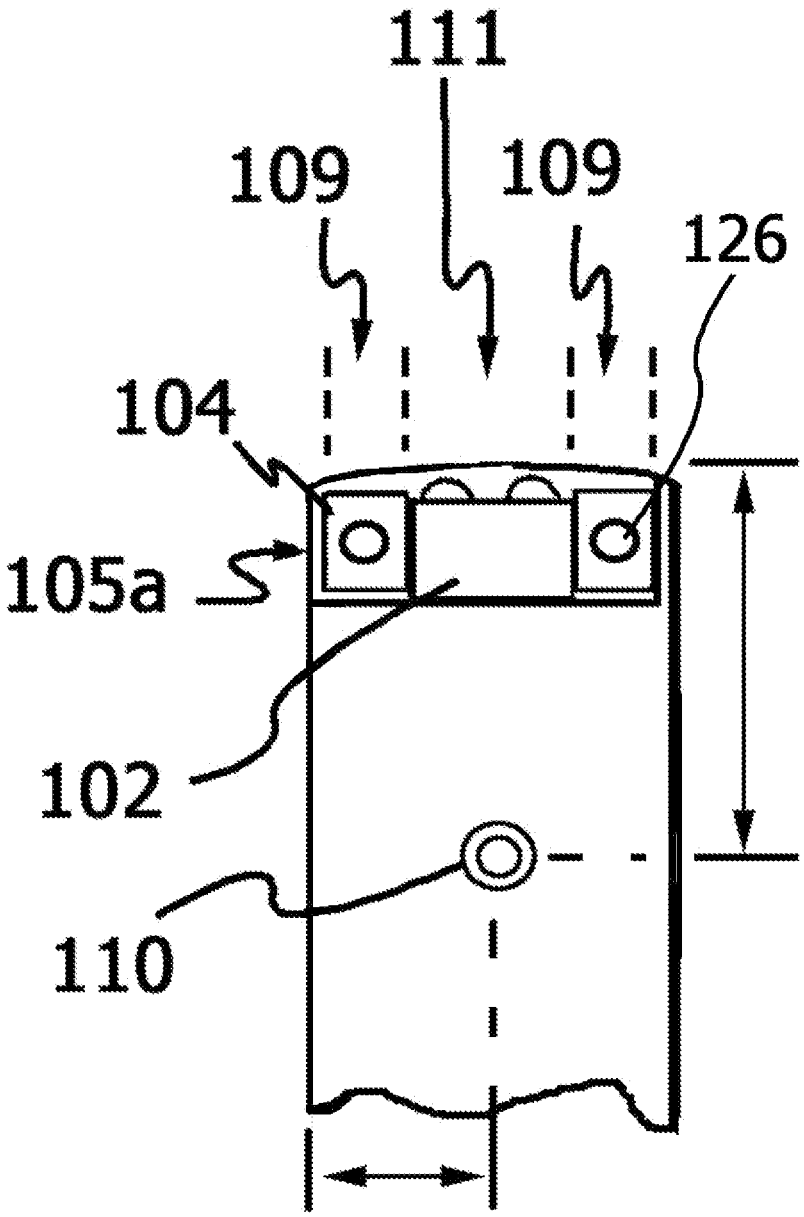
FIG. 9*c* is similar to the image depicted in FIG. 9*b* but showing exemplary distances.
Figure 9D:
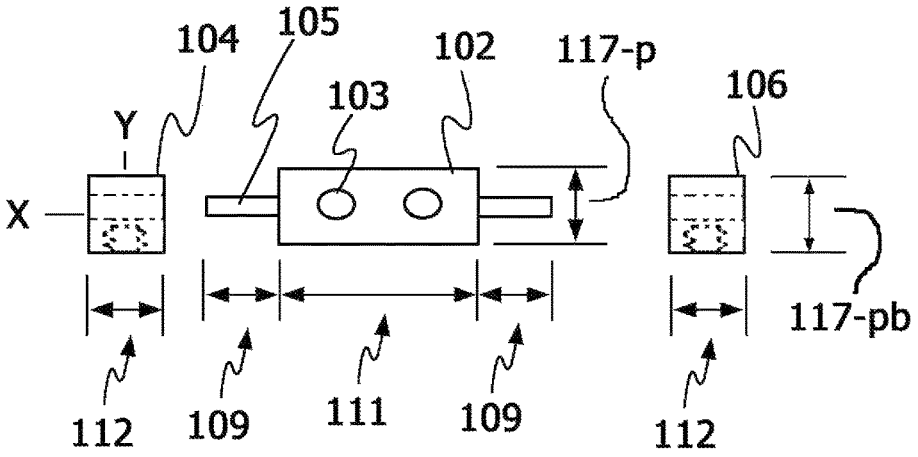
FIG. 9*d* is a close up view of the pintle block and pillow blocks depicted in FIG. 9*a;*
Figure 9E:
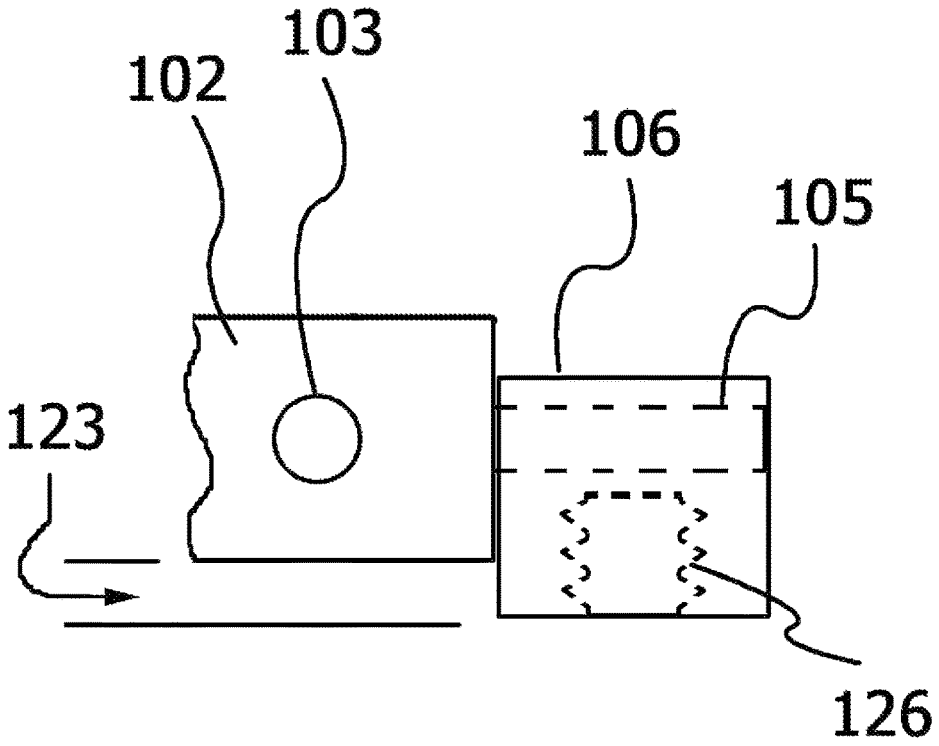
FIG. 9*e* is a close up view of a pintle block associated with a pillow block depicting exemplary spacing and distances.
Figure 9F:
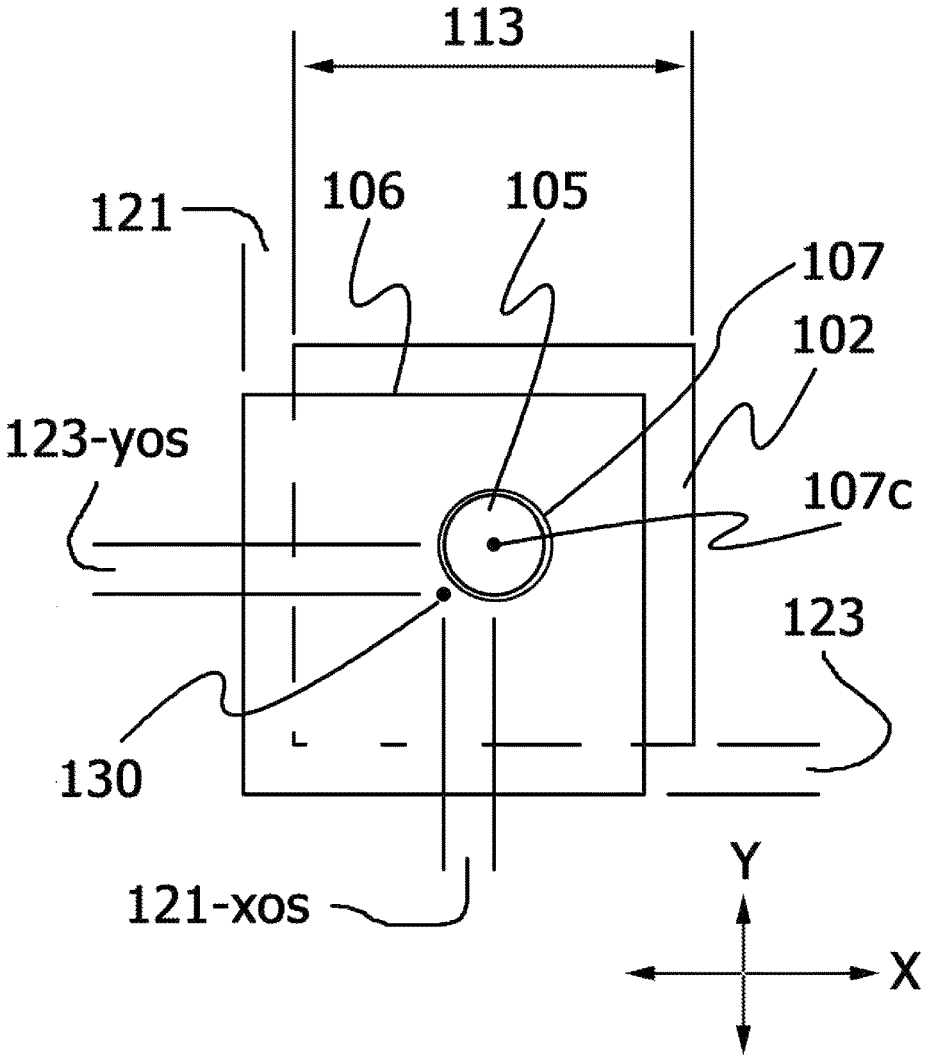
FIG. 9*f* is a side elevational close up view of a pintle block in the background associated with a pillow block in the foreground.
Figure 9G:
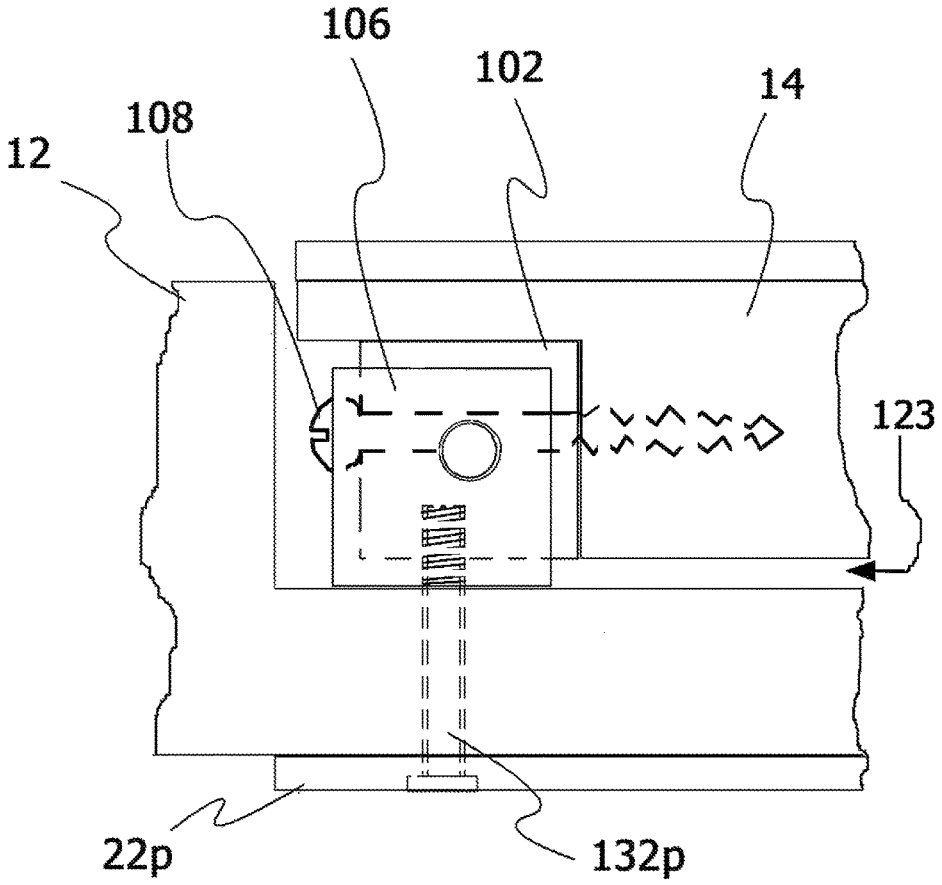
FIG. 9*g* is a side elevational close up view of the pintle block and pillow block of FIG. 9*f* adjustably associating a guitar neck with a guitar body.
Figure 10:
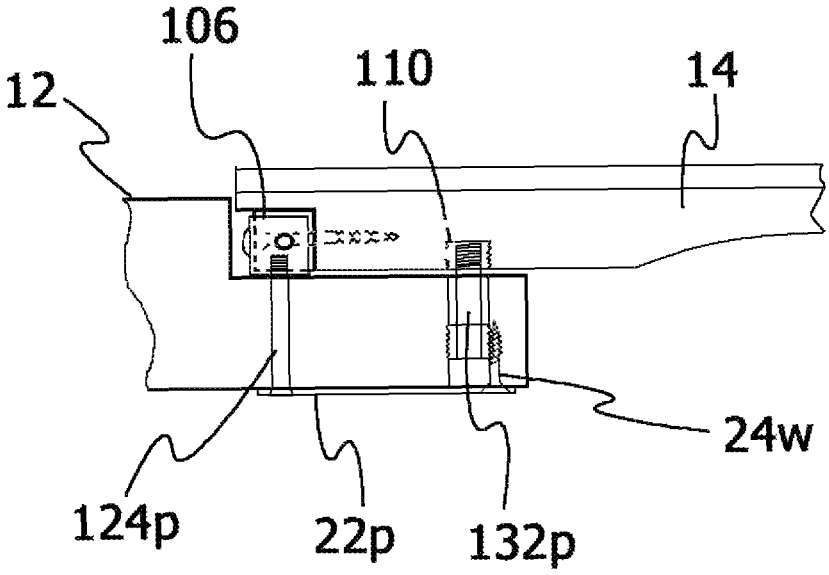
FIG. 10 is a side elevational view of a guitar body associated with a guitar neck using the pintle block and pillow blocks depicted above.

Referring now to FIG. 9*a* through FIG. 10, another alternative embodiment of the invention is presented which utilizes a pintle adjuster assembly (100) comprising a pintle block (102) and two pillow blocks (104, 106), adjustment mechanism receiver (110), spacer (34), adjustment mechanism (132*p*) and optionally back-plate (22*p*) or a bushing. Restated, the currently preferred embodiment includes neither a body-plate (60) nor a neck-plate (40).

Referring now to FIG. 9*a*, a presently preferred embodiment of a pintle adjustor assembly (100) is presented. Described generally, the pintle adjustor assembly comprises a pintle block (102) defining a first pintle block end and an opposing second pintle block end. A first pintle (105*a*) is defined at the first pintle block end and an opposing second pintle (105*b*) is defined at the second pintle block end. For the preferred embodiment, the first pintle and said second pintle are integral to said pintle block (102). However, embodiments where the first pintle and second pintle are separate components that are mechanically associated with the first pintle block end and the second pintle block end, respectively, do not depart from the scope and spirit of the present invention.

The pintle block is configured for being mechanically associated with a pintle interface defined by the first end and on the back side of a first component (e.g. a neck assembly), wherein the first component defines a first end and an opposing second end and a front side and an opposing back side. Suitable pintle interfaces include channels, slots, groves, dados, notches, voids, cut outs, rabbits, niches, slits, and recesses defined by the first end of said first component. The pintle adjustor assembly further comprises an adjustment mechanism receiver (110) configured for being associated with the back side of said first component a predefined distance from the pintle interface. The pintle adjustor assembly further comprises two pillow blocks where each pillow block is configured for being movably associated with a pintle in an off-set configuration (as defined in more detail below). The pillow blocks are suitably configured for being mechanically associated with a second-component-interface defined by a second component wherein the second-component-interface defines two pillow block attachment points and a second-component-interface-port.

An adjustment mechanism (132*p*) is also provided and is suitably configured for being inserted into the second-component-port and adjustably associated with the adjustment mechanism receiver so that the distance between adjacent surfaces of the first component and said second component may be varied by activating said adjustment mechanism.

Moe specifically, still referring now to FIG. 9*a*, one should first understand that the inclusion of a back-plate (22*p*) is optional and a bushing may be used instead of a back-plate. The preferred pintle adjustor assembly (100) comprises a pintle block (102) defining a generally rectangular prism (please note such rectangular prism may have the leading edges rounded off as depicted in FIG. 9*a*, however, such rounded leading edges are optional) with two mounting holes (103) running transversely through pintle block (102) wherein such mounting holes are configured for receiving attachment mechanisms (108). For the current embodiment of the invention, attachment mechanisms (108) are wood screws although any suitable attachment mechanisms may be used without departing from the scope and spirit of the present invention. Pintle block (102) further defines two pintles (105*a*) and (105*b*) extending from opposing ends of pintle block (102) a predefined distance referred to as the pintle post length (109, FIG. 9*b*).

As depicted in FIG. 9*b*, for this embodiment, a hole is drilled into the back side of neck assembly (14) a predefined insert distance (101-*i*) along neck assembly (14). It should be noted that such hole does not extend all the way through neck assembly (14). Hollow threaded insert (110) is then threaded into such hole. One of ordinary skill in the art will appreciate that the thread type is selected in consideration of the material from which the neck is constructed. As will be described later, since neck assembly (14) is composed of wood, hollow threaded insert (110) defines wood threads around the outer perimeter. Similarly, since action adjustment mechanism (132*p*) defines a machine screw, threaded insert (110) defines machine threads around the inner perimeter. The distance from the center of pintles 105 (when pintle block (102) is mechanically associated with neck assembly (14)) and the hole configured to receive threaded insert (110) is called insert-distance (101-*i*) and is substantially equal to hole-plate distance (101-*p*, FIG. 9*a* as defined later) so that back-plate access port (125) is in alignment with threaded insert (110) when pintle adjustor (100) is installed as described below. Threaded insert (110) is configured to receive action adjustment mechanism (132*p*). For the currently preferred embodiment, action adjustment mechanism (132*p*) is a shoulder bolt defining machine screw threads as described above.

For prior art necks not defining a pintle interface (114), such notch is carved out of the back side of the first end of neck assembly (14). The depth of pintle interface (114) is substantially equal to the height (117-*p*, FIG. 9*d*) of pintle block (102). The width of pintle interface (114) is slightly longer than the combined length of pintle-body-length (111) and two times the pintle-post-length (109) as best seen in FIGS. 9*c* and 9*d* [i.e. length (111)+length 109+length 109)]. It should be noted that for the preferred embodiment, the width of pintle interface (114) is not as wide as neck assembly (14) leaving a neck flange (116, FIG. 9*b*). Thus, when pintle block (102) is associated with first end of neck assembly (14), the outside surface of such component is about even with the back side of neck assembly (14) (see FIG. 10) and the combination of pintle and pillow blocks fit inside (i.e. is not wider than) pintle interface (114) (see FIG. 9*c*).

Pintle

As best seen in FIGS. 9*a* and 9*d*, pintle block (102) defines a generally rectangular prism having a body section and two opposing posts/pins/pintles. Pintle block (102) is described as being generally rectangular as the leading edges may be rounded as depicted in FIG. 9*a*. The body section of pintle block (102) defines a pintle body height (117-*p*), a pintle body length (111), and a pintle body width/depth (113, FIG. 9*f*) (about equal to the pintle body height). The body section further defines two mounting holes (103) running transversely through pintle block (102). Pintle block (102) further defines two opposing and substantially identical post/pintle sections (105*a*) and (105*b*), one extending from the approximate center point of each end of the body section thereby defining a pintle post length (109). For the currently preferred embodiment of the invention, pintle post length (109) is substantially equal to the pillow block length (112).

Pillow Blocks

As best seen in FIGS. 9*a*, 9*d*, 9*e*, and 9*f*, for the currently preferred embodiment of the invention, pillow blocks (104) and (106) define a cube. Such pillow blocks defined block attachment hole (126) in the approximate center of one side and configured to receiver back-plate attachment mechanisms (124*p*). Attachment hole (126) does not extend all the way through the pillow block. For the preferred embodiment, attachment mechanisms (124*p*) are machine screws although, (as with the other configurations), any suitable device may be used for attachment mechanisms (124*p*)

Pillow blocks (104) and (106) further define pillow block holes (107) configured for receiving pintles (105). As best seen in FIG. 9*f*, for this embodiment of the invention, pillow block holes (107) are not in the center (130) of the pillow block. Instead, the pillow blocks define pillow block holes (107) with a center (107*c*) positioned at an x-off set and y-off set point from center (130). As depicted in FIG. 9*f*, x-offset (121-*xos*) is a predefined x-distance from the center point (130) thereby creating block x-offset (121). Similarly, the pillow blocks define a Y offset (123-*yos*) that is a predefined y-distance from the center point (130) thereby creating block y-offset (123). One of ordinary skill in the art will appreciate that such offsets allow for rotation to adjust the string action as described later. For the preferred embodiment, the 121-*xos* is 1/16 of an inch (in the X direction) and the 123-*yos* is 1/16 of an inch (in the Y direction).

Pintle Method

Exemplary methods for installing a pintle adjustor assembly are now considered in more detail. Initially, it will be assumed that a pintle interface (114) (as described above) is already defined by first end of neck assembly (14) (i.e. the part of the neck that attached to the guitar body).

As best seen in FIG. 9*b*, a pillow block (106) is associated with pintle block (102) by sliding pintle (105*b*) into pillow block hole (107) so that the pillow block attachment hole (126) is perpendicular to mounting holes (103) and co-planer with the back surface of neck assembly (14). Such components are inserted into pintle interface (114) so that the free side of pillow block (106) is adjacent to an optional neck flange (116) and the inter surface of pintle block (102) is touching a surface of pintle interface (114). If done correctly, the one free surface of pintle block (102) will be about flush with the back surface of neck assembly (14) whereas the corresponding surfaces of the pillow blocks (106) will be offset by the y-offset (123-*yos*, FIG. 9*f* and FIG. 9*g*) distance. It should be noted that the pillow block (106) should be oriented so that surface defining the block attachment hole (126) is in horizontal alignment with the back surface of neck assembly (14) (as shown in FIG. 9*b* and FIG. 9*c*). Please note that neck flange (116) is optional depending on the design of the guitar and body style.

Next, pintle block (102) is mechanically associated with the pintle interface defined by the first end of neck assembly (14) using attachment devices (108). For the current embodiment, attachment devices (108) are wood screws. Next, pillow block (104) is associated with pintle block (102) by sliding pintle post (105*a*) into block post hole (107) so that the block attachment hole (126) is perpendicular to mounting holes (103). It should be noted that the pillow block (104) should be oriented so that block attachment hole (126) is in alignment with the back surface of neck assembly (14) (as shown in FIG. 9*b* and FIG. 9*c*). Restated, pillow block (104) should be orientated the same as pillow block (106) respective to pintle block (102).

Next, the center line distance (101-*p*) is measured. At a point substantially equidistant (101-*p*) from the center point of pillow block attachment hole (126), as depicted in FIG. 9*b*, and half way between the side edges of neck assembly (14), a hole is drilled configured to receive the hollow threaded insert (110). Hollow threaded insert (110) is then threaded into such hole so the outer end surface of hollow threaded insert (110) is approximately even (flush) with the back surface of neck assembly (14) as depicted in FIG. 9*b*.

Next, the neck assembly (14) is fitted onto the body interface so that the pillow block attachment holes (126) are in alignment with the corresponding body holes. Additionally, body access port (53) should be in alignment with threaded insert (110). Spacer (34) is inserted into body access port (53) and action adjustment mechanism (132*p*) is then inserted into body access port (125) and through spacer (34) and screwed into threaded insert (110). One suitable embodiment of spacer (34) is a threaded bushing.

Next, back-plate (22*p*) is then associated with the back side of body assembly (12) so that the back two plate holes are in alignment with corresponding body holes and back-plate access port (125) is in alignment with action adjustment mechanism (132*p*). Attachment devices (124*p*) are then inserted through the back-plate holes and body holes and screwed into the pillow blocks. Finally, wood screws (24*w*) are inserted through the two front back-plate holes and screwed into body assembly (12) thereby completing the installation as depicted in FIG. 10.

Universal Interface

One of ordinary skill in the art will appreciate that the above described embodiments of the invention have the potential to provide a universal interface allowing neck assembly (14) to be quickly and easily removed from body assembly (12) thereby allowing a second neck assembly (14), configured with a neck-plate (40), to be quickly associated with body assembly (12). Such flexibility allows a guitarist to have a plurality of guitar neck assembly (14) and string (16) configurations while maintaining a common guitar body and associated electronics and electronic pick-ups (such is just one advantage of a universal interface).

For the universal interface feature, a universal body interface and universal neck interface length and width are determined. An exemplary universal body interface would include a body interface (60*bi*) defining a standard body interface width, length, and depth. Such universal body interface would further include a body-plate defining a standard pivot member receiver position, a standard hole pattern for body-plate holes (62), and a standard body-plate access port (51) position.

Similarly, an exemplary universal neck interface would include a neck interface (40*ni*) defining a standard neck interface width, length, and depth. Such universal neck interface would further include a neck-plate defining a standard pivot member receiver position, a standard hole pattern for neck-plate holes (48) and adjustment receiver (50).

For such embodiment, the universal neck interface is adjustably associated with the universal body interface using a pivot member (39) and an adjustment mechanism (32) as described above. For the universal embodiment, access to pivot member (39) is provided so that the neck assembly (14) may be disassociated from the body assembly (12) by removing pivot member (39) and unscrewing adjustment mechanism (32).

Using the above universal neck interface and body interface technology, a plurality of guitar bodies (12) are each configured with a universal body interface. Similarly, a plurality of guitar necks (14) are each configured with a universal neck interface. One of ordinary skill in the art will recognize that such technology allows a user to easily and quickly remove a neck comprising a universal interface from a body comprising a universal interface simply by removing pivot member (39) and unscrewing adjustment mechanism (32). Additionally, any one of a plurality of necks (comprising universal neck interface) may be quickly associated with any one of a plurality of bodies (comprising a universal body interface).

While the present subject matter has been described in detail with respect to specific embodiments thereof, it will be appreciated that those skilled in the art, upon attaining an understanding of the foregoing may readily adapt the present technology for alterations to, variations of, and equivalents to such embodiments. Accordingly, the scope of the present disclosure is by way of example rather than by way of limitation, and the subject disclosure does not preclude inclusion of such modifications, variations, and/or additions to the present subject matter as would be readily apparent to one of ordinary skill in the art.

What is claimed is:

1. An apparatus for movably associating two components, said apparatus comprising:

a first plate defining a pair of opposed surfaces and configured for being mechanically associated with a first component, said first plate defining a first pivot member receiver and an adjustment mechanism receiver;

a second plate defining a pair of opposed surfaces and configured for being mechanically associated with a second component, said second component defining an opening there through thereby defining an second-component-port having a second-component-port-diameter, said second plate defining a second pivot member receiver and a plate-port, wherein said plate-port is configured to be in alignment with said second-component-port when said second plate is associated with a second component;

wherein said first component and said second component define a stringed musical instrument comprising a body assembly mechanically associated with a neck assembly at a body-neck interface and wherein said first component is said neck assembly and said second component is said body assembly;

a pivot member configured for being movably associated with said first pivot member receiver and said second pivot member receiver when said pivot member receivers are in alignment and said first plate is adjacent to said second plate thereby defining a plate-gap there between;

wherein said first plate and said second plate are configured so that said adjustment mechanism receiver is in alignment with said plate-port and said second-component-port when said pivot member is being received by said first pivot member receiver and said second pivot member receiver;

an adjustment mechanism comprising a shaft portion and a head portion, said shaft portion defining a shaft portion length and a shaft portion diameter, and wherein said head portion defines a head portion length, a head portion diameter, and a head-surface at a free end of said head portion, and wherein said shaft portion diameter is less than said head portion diameter;

wherein said head portion diameter is smaller than said second-component-port-diameter so that the head portion will fit inside said second-component-port;

a spacer configured for being disposed inside said second-component-port between said plate port and said head portion, said spacer defining a hollow cylinder defining a spacer-outer-diameter and a spacer-inner-diameter and a spacer-length and wherein said spacer-outer-diameter is less than said second-component-port-diameter but greater than a plate-port-diameter and wherein said spacer-inner-diameter is smaller than said head portion diameter;

wherein said shaft portion diameter is smaller than the plate-port-diameter;

wherein the length of said shaft portion is selected so that said shaft portion extends from said head portion and through said spacer, through said plate-port and to said adjustment mechanism receiver;

wherein a free end of said shaft portion defines a first structure configured for being associated with a second structure defined by said adjustment mechanism receiver, said second structure configured for receiving said first structure wherein said first structure and said second structure are configured for converting rotational movement of said shaft portion to linear movement of said first plate;

an adjustment mechanism retainer comprising a hollow insert, defining a hollow insert inside diameter and hollow insert outside diameter, configured for being removably mechanically associated with said second-component-port wherein said hollow insert inside diameter is smaller than said head portion diameter;

wherein at least one of said head portion length and said spacer length is predefined to limit linear movement of said adjustment mechanism inside said second-component-port;

wherein said adjustment mechanism is activated by rotating said head portion in one of a plurality of directions thereby rotating said first structure where such rotational movement is converted to linear movement of said first plate thereby varying said plate-gap; and wherein said stringed musical instrument is a guitar and wherein the guitar's string action is adjusted by varying said plate-gap.

2. An apparatus for movably associating two components as in claim 1, wherein said adjustment mechanism is a socket head cap screw.

3. An apparatus for movably associating two components as in claim 1, wherein said first structure defines a first thread type and said second structure defines a second thread type.

4. An apparatus for movably associating two components as in claim 1, wherein said hollow insert defines a threaded bushing defining the shape of a hollow cylinder defining a first bushing end and an opposing second bushing end and an outer bushing diameter and an inner bushing diameter wherein said bushing further defines outer threads and wherein said outer bushing diameter is sized so that the first bushing end may be inserted into and threaded into said second-component-port.

5. An apparatus for movably associating two components as in claim 2, wherein adjusting said plate-gap has less than a 2% effect on the guitar's pick action.

6. An apparatus for movably associating two components as in claim 2, wherein adjusting said plate-gap has less than a 10% effect on the guitar's pick action.

7. An apparatus for adjusting the string action of stringed musical instrument comprising a plurality of strings, where the stringed musical instrument comprises a neck element and a body element defining a body port having a body port diameter and wherein said plurality of strings runs along said neck element defining the musical instrument's string action therebetween, said apparatus comprising:

a neck plate (NP) defining a pair of opposed surfaces connected by a peripheral edge wherein a first NP-surface defines a neck interface surface configured for being associated with the neck element of a stringed musical instrument and a second NP-surface defines a NP-gap surface and wherein said neck plate further defines an adjustment mechanism receiver;

a body plate (BP) defining a pair of opposed surfaces connected by a peripheral edge wherein a first BP-surface defines a body interface surface configured for being mechanically associated with the body element of said stringed musical instrument and a second BP-surface defines a BP-gap surface and wherein said body plate further defines a BP-port defining a BP-port diameter;

a pivot member movably mechanically associating said neck plate with said body plate so that said adjustment mechanism receiver is in alignment with said BP-port and wherein the NP-gap surface is held adjustably adjacent to said BP-gap surface thereby defining an adjustable plate-gap therebetween;

an adjustment mechanism defining a shaft portion having a shaft diameter and a head portion having a head diameter wherein the head diameter is greater than the shaft diameter and said BP-port diameter and smaller than said body port diameter so that the head portion can fit inside said body port and wherein the shaft diameter is smaller than said BP-port diameter and wherein the shaft portion is configured to extend through said BP port to said adjustment mechanism receiver and movably mechanically associate with said adjustment mechanism receiver;

an adjustment mechanism retainer comprising a hollow insert disposed inside said body port, and defining a hollow insert inside diameter and hollow insert outside diameter, wherein said hollow insert inside diameter is smaller than said head diameter and configured to allow access to said adjustment mechanism; and wherein said plate-gap is varied by activating said adjustment mechanism thereby adjusting the string action between said plurality of strings and said neck element without disassembly of the stringed musical instrument while maintaining stability between the neck element and the body element.

8. An apparatus for adjusting the string action of stringed musical instrument as in claim 7, wherein the stringed musical instrument is a guitar.

9. An apparatus for adjusting the string action of stringed musical instrument as in claim 8, wherein said adjustment mechanism provides one adjustment point for simultaneously adjusting said string-action of all said plurality of strings simultaneously.

10. An apparatus for adjusting the string action of stringed musical instrument as in claim 9, wherein said adjustment mechanism is a socket head cap screw.

11. An apparatus for adjusting the string action of stringed musical instrument as in claim 7, wherein said adjustment mechanism receiver defines a first thread type and a segment of said shaft defines a second thread type configured for being movably mechanically associated with said first thread type.

12. An apparatus for adjusting the string action of stringed musical instrument as in claim 7, further comprising a spacer configured for being disposed between said BP-port and the head portion of said adjustment mechanism, said spacer defining a hollow cylinder defining a spacer-outer-diameter and a spacer-inner-diameter wherein said spacer-outer-diameter is greater than said BP-port diameter and wherein said spacer-inner-diameter is smaller than said head diameter and wherein said shaft portion is suitably configured for being inserted through said spacer, through said BP-port and movably associated with said adjustment mechanism receiver.

13. An apparatus for adjusting the string action of stringed musical instrument as in claim 7, wherein said hollow insert defines a threaded bushing and wherein said adjustment mechanism is a socket head cap screw.

14. A method for movably associating a neck element to a body element of a guitar, wherein the body element defines body port having a body port diameter, to allow adjustment of the guitar's string action without disassembly, said method comprising the steps of:

associating a neck plate defining a pair of opposed surfaces with the neck element of a guitar wherein said neck plate further defines an adjustment element receiver;

providing a body plate defining a pair of opposed surfaces and a body plate (bp) port, defining a bp-port diameter and associating said body plate with the body element of said guitar so that said body plate port is in alignment with a body port defined by said body element;

movably associating said neck plate to said body plate with a pivot element so that said neck plate is held adjacent to said body plate to define a plate-gap between said neck plate and said body plate and wherein said adjustment element receiver is in alignment with said body plate port;

providing an adjustment mechanism defining a shaft portion having a shaft diameter and a shaft length, and a head portion having a head diameter, a head length, and a head surface at a free end of said head portion wherein said head diameter is greater than said bp-port diameter and wherein said shaft diameter is smaller than said head diameter and said bp-port diameter;

inserting said adjustment mechanism into said body port so that said shaft portion passes through said body port, through said body plate port and movably mechanically associating said shaft portion with said adjustment mechanism receiver and wherein said head portion is disposed inside said body port so that the head surface is flush with an outer surface said body element; and providing a retainer to secure said adjustment mechanism inside said body port wherein said retainer provides access to said head portion to allow the head portion to be rotated there by changing said plate-gap thereby adjusting the string action of said guitar while maintaining stability and alignment of the neck element relative to the body element and without requiring disassembly of said guitar; and inserting a spacer into said body port between the body plate and the head portion wherein said spacer defines a hollow cylinder with a spacer-outer-diameter and a spacer-inner-diameter and a spacer-length wherein the spacer-outer-diameter is greater than the bp-port diameter but less than said body port diameter.

15. A method for movably associating the neck element to the body element of a guitar as in claim 14, wherein said shaft length is selected so that so that said shaft portion passes through said body port, through said spacer, through said body plate port and is movably mechanically associated with said adjustment mechanism receiver and wherein said head portion is disposed inside said body port so that said head surface is flush with the outer surface said body element.

16. A method for movably associating the neck element to the body element of a guitar as in claim 15, wherein said adjustment mechanism receiver defines a first thread type and a segment of said shaft portion defines a second thread type configured for being movably mechanically associated with said first thread type.

17. A method for movably associating the neck element to the body element of a guitar as in claim 14, wherein said adjustment mechanism is a socket head cap screw.

18. A method for movably associating the neck element to the body element of a guitar as in claim 14, wherein said retainer is a hollow threaded bushing configured for being screwed into said body port.

19. A method for movably associating the neck element to the body element of a guitar as in claim 14, wherein activating said adjustment mechanism changes the string action of said guitar while having less than a ten percent effect on the guitar's pick action.

20. A method for movably associating the neck element to the body element of a guitar as in claim 14, wherein said adjustment mechanism provides one adjustment point for simultaneously adjusting the string-action of all the guitar's strings simultaneously.

* * * * *